US011588220B2

(12) United States Patent
Lee et al.

(10) Patent No.: US 11,588,220 B2
(45) Date of Patent: Feb. 21, 2023

(54) ELECTRONIC DEVICE INCLUDING ANTENNA MODULE TO WHICH DIELECTRIC SHEET IS ATTACHED

(71) Applicant: Samsung Electronics Co., Ltd., Suwon-si (KR)

(72) Inventors: Yunbum Lee, Suwon-si (KR); Seongbeom Hong, Suwon-si (KR); Kyunghoon Moon, Suwon-si (KR); Seunggil Jeon, Suwon-si (KR); Jaeyoung Huh, Suwon-si (KR); Jinsang Kim, Suwon-si (KR); Sungchul Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 132 days.

(21) Appl. No.: 17/162,110

(22) Filed: Jan. 29, 2021

(65) Prior Publication Data

US 2021/0249751 A1 Aug. 12, 2021

(30) Foreign Application Priority Data

Feb. 6, 2020 (KR) ..... 10-2020-0014429

(51) Int. Cl.
*H01Q 1/02* (2006.01)
*H01Q 9/04* (2006.01)
(Continued)

(52) U.S. Cl.
CPC ..... *H01Q 1/02* (2013.01); *H01Q 1/2283* (2013.01); *H01Q 1/243* (2013.01); *H01Q 1/40* (2013.01);
(Continued)

(58) Field of Classification Search
CPC ..... H01Q 1/02; H01Q 1/243; H01Q 1/2283; H01Q 1/40; H01Q 9/0407; H01Q 19/09; H01Q 21/08; H01Q 21/28; H01Q 23/00
See application file for complete search history.

(56) References Cited

U.S. PATENT DOCUMENTS 5,926,136 A 7/1999 Ohtsuka et al.
10,141,625 B1 11/2018 Ryu et al.
(Continued)

FOREIGN PATENT DOCUMENTS

JP 2019097026 A 6/2019
KR 10-2020-0011183 A 2/2020

OTHER PUBLICATIONS

International Search Report and written opinion dated May 26, 2021, issued in International Application No. PCT/KR2021/001235.

(Continued)

*Primary Examiner* — Robert Karacsony
(74) *Attorney, Agent, or Firm* — Jefferson IP Law, LLP

(57) ABSTRACT

An electronic device is provided. The electronic device includes a display having a first surface, a metal frame structure configured to form a side surface of the electronic device, a rear plate having a second surface facing a third direction, at least one antenna module disposed inside the side surface and having a radiation surface, at least one dielectric layer having at least a partial region attached to the radiation surface, and a wireless communication circuit configured to transmit or receive an radio frequency (RF) signal to or from the at least one antenna module, in which the at least one dielectric layer includes a first dielectric sheet and a second dielectric sheet, in which the first dielectric sheet is made of a thermal conductive material having a first permittivity and the second dielectric sheet is (Continued)

made of a material having a second permittivity larger than the first permittivity.

20 Claims, 26 Drawing Sheets

(51) Int. Cl.

| | |
|---|---|
| ***H01Q 21/08*** | (2006.01) |
| ***H01Q 19/09*** | (2006.01) |
| ***H01Q 21/28*** | (2006.01) |
| ***H01Q 23/00*** | (2006.01) |
| ***H01Q 1/24*** | (2006.01) |
| ***H01Q 1/22*** | (2006.01) |
| ***H01Q 1/40*** | (2006.01) |

(52) U.S. Cl.
CPC ..... *H01Q 9/0407* (2013.01); *H01Q 19/09* (2013.01); *H01Q 21/08* (2013.01); *H01Q 21/28* (2013.01); *H01Q 23/00* (2013.01)

(56) References Cited

U.S. PATENT DOCUMENTS

| | | | | |
|---|---|---|---|---|
| 10,320,051 | B2 | 6/2019 | Chiu | |
| 10,389,007 | B1 | 8/2019 | Choi et al. | |
| 11,228,105 | B2 * | 1/2022 | Yun | H01Q 1/44 |
| 2015/0138023 | A1 | 5/2015 | Hyun et al. | |
| 2017/0250120 | A1 | 8/2017 | Harauchi et al. | |
| 2019/0104212 | A1 | 4/2019 | Lee et al. | |
| 2019/0252771 | A1 | 8/2019 | Yong et al. | |
| 2019/0386380 | A1 | 12/2019 | Ham et al. | |
| 2021/0234258 | A1 * | 7/2021 | Islam | H01Q 21/24 |

OTHER PUBLICATIONS

Extended European Search Report dated Dec. 12, 2022, issued in European Patent Application No. 21750956.1-1205.

* cited by examiner

28GHz

——— : WITHOUT DIELECTRIC SHEET ATTACHED

------- : WITH DIELECTRIC SHEET ATTACHED

39GHz

——— : WITHOUT DIELECTRIC SHEET ATTACHED

------- : WITH DIELECTRIC SHEET ATTACHED

ELECTRONIC DEVICE INCLUDING ANTENNA MODULE TO WHICH DIELECTRIC SHEET IS ATTACHED

CROSS-REFERENCE TO RELATED APPLICATION(S)

This application is based on and claims priority under 35 U.S.C. § 119(a) of a Korean patent application number 10-2020-0014429, filed on Feb. 6, 2020, in the Korean Intellectual Property Office, the disclosure of which is incorporated by reference herein in its entirety.

BACKGROUND

1. Field

The disclosure relates to an electronic device including an antenna module to which a dielectric sheet is attached.

2. Description of Related Art

Development of wireless communication technology has been followed by widespread use of electronic devices (for example, electronic devices for communication), and this has caused exponentially increasing use of contents. Such a rapid increase in content use been followed by a rapidly increasing demand for wireless traffic, and the need for high-speed data transmission has gradually increased as a result.

Such a demand for high-speed data communication has gradually increased electronic devices supporting high-speed wireless communication technologies including next-generation wireless communication technology (for example, $5^{th}$ generation (5G) communication) using millimeter waves (mmWave) of 20 GHz or higher and Wireless Gigabit Alliance (WIGIG) (for example, 802.11AD).

The above information is presented as background information only to assist with an understanding of the disclosure. No determination has been made, and no assertion is made, as to whether any of the above might be applicable as prior art with regard to the disclosure.

SUMMARY

The next-generation wireless communication technology mainly uses millimeter waves (mmWave) that are substantially 20 GHz or higher, and thus may use an array antenna having multiple antenna elements arranged at an interval in order to overcome the high level of free space loss resulting from the frequency characteristics and to increase the antenna gain. The gain of the array antenna increases in proportion to the number of unit antenna elements, but the increased volume may make it difficult to secure the mounting space.

In an attempt to secure the amounting space the array antenna, it has been proposed to dispose the array antenna on the inner wall of a side surface of the electronic device. The mounting space of the array antenna may be secured by such an approach, but the metal frame that forms the side surface of the electronic device may come to cover a region of the radiation surface of the array antenna.

As a result, due to an electric field component reflected by the metal frame, an antenna beam radiated by the array antenna may be formed in such a direction that the same is partially tilted toward the rear plate of the electronic device, instead of the boresight direction, thereby degrading the antenna performance.

In addition, electronic devices supporting the next-generation wireless communication technology have a large amount of data to be operated, and thus include multiple active elements (for example, amps of radio frequency (RF) front ends, phase modulators, and the like) for a high data transmission rate. In this case, the array antenna may generate heat in the process of transmitting or receiving data.

Therefore, it has been proposed to attach a dielectric sheet having a low permittivity on a surface of the metal frame so as to radiate heat generated by the antenna array. However, this approach requires an air gap between the dielectric sheet and the antenna array in order to prevent degradation of the antenna performance. As a result, the dielectric sheet and the array antenna come to transfer heat through air, thereby degrading the heat radiation efficiency.

Aspects of the disclosure are to address at least the above-mentioned problems and/or disadvantages and to provide at least the advantages described below. Accordingly, an aspect of the disclosure is to provide an electronic device capable of minimizing the influence of a metal frame structure by using a dielectric sheet having a combination of a low permittivity and a high permittivity, thereby improving the antenna coverage and effectively radiating heat generated by the array antenna.

Additional aspects will be set forth in part in the description which follows and, in part, will be apparent from the description, or may be learned by practice of the presented embodiments.

In accordance with an aspect of the disclosure, an electronic device is provided. The electronic device includes a display having a first surface facing a first direction, a metal frame structure configured to form a side surface, which faces a second direction perpendicular to the first direction, of the electronic device, a rear plate having a second surface facing a third direction opposite to the first direction, at least one antenna module disposed inside the side surface and having a radiation surface facing the second direction, at least one dielectric layer having at least a partial region attached to the radiation surface of the antenna array, and disposed between the at least one antenna module and the side surface, and a wireless communication circuit configured to transmit or receive an RF signal in a predetermined frequency band to or from the at least one antenna module. The at least one dielectric layer may include a first dielectric sheet attached to at least a partial region of the radiation surface of the antenna module and a second dielectric sheet disposed on the first dielectric sheet in the second direction. The first dielectric sheet may be made of a thermal conductive material having a first permittivity, and the second dielectric sheet may be made of a material having a second permittivity larger than the first permittivity.

In accordance with another aspect of the disclosure, an electronic device is provided. The electronic device includes a display having a first surface facing a first direction, a metal frame structure configured to form a side surface, which faces a second direction perpendicular to the first direction, of the electronic device, a rear plate having a second surface facing a third direction opposite to the first direction, at least one antenna module disposed inside the side surface and having a radiation surface facing the second direction, at least one dielectric layer having at least a partial region attached to an inner side of the side surface, and disposed between the at least one antenna module and the side surface, and a wireless communication circuit configured to transmit or receive an RF signal in a predetermined frequency band to or from the at least one antenna module. The at least one dielectric layer may include a first dielectric sheet disposed on the radiation surface of the at least one antenna module in the second direction and a second dielectric sheet disposed between the first dielectric sheet and the side surface and having a surface attached to the inner side of the side surface. The first dielectric sheet may be made of a thermal conductive material having a first permittivity, and the second dielectric sheet may be made of a material having a second permittivity larger than the first permittivity.

In accordance with another aspect of the disclosure, an electronic device is provided. The electronic device includes a display having a first surface facing a first direction, a metal frame structure configured to form a side surface, which faces a second direction perpendicular to the first direction, of the electronic device, a rear plate having a second surface facing a third direction opposite to the first direction, at least one antenna module disposed inside the side surface, at least one dielectric layer disposed between the at least one antenna module and the side surface, and a wireless communication circuit configured to transmit or receive an RF signal in a predetermined frequency band to or from the at least one antenna module. The at least one antenna module may include a printed circuit board having a third surface facing the second direction and a fourth surface facing an opposite direction to the second direction, and a plurality of antenna elements disposed on the first surface of the printed circuit board. The at least one dielectric layer may include a first dielectric sheet attached to at least a partial region of the third surface of the printed circuit board and made of a thermal conductive material having a first permittivity and a second dielectric sheet disposed on the first dielectric sheet in the second direction and made of a material having a second permittivity larger than the first permittivity. The second dielectric sheet may include at least one first opening formed at a position corresponding to at least a partial region of the plurality of antenna elements.

An electronic device according to an embodiment can alleviate antenna radiation performance degradation resulting from a metal frame structure.

In addition, an electronic device according to an embodiment can secure an antenna beam coverage in the boresight direction.

Moreover, an electronic device according to an embodiment can diffuse heat generated by an antenna module to another element (for example, metal frame structure) inside the electronic device, thereby improving the heat radiation efficiency.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
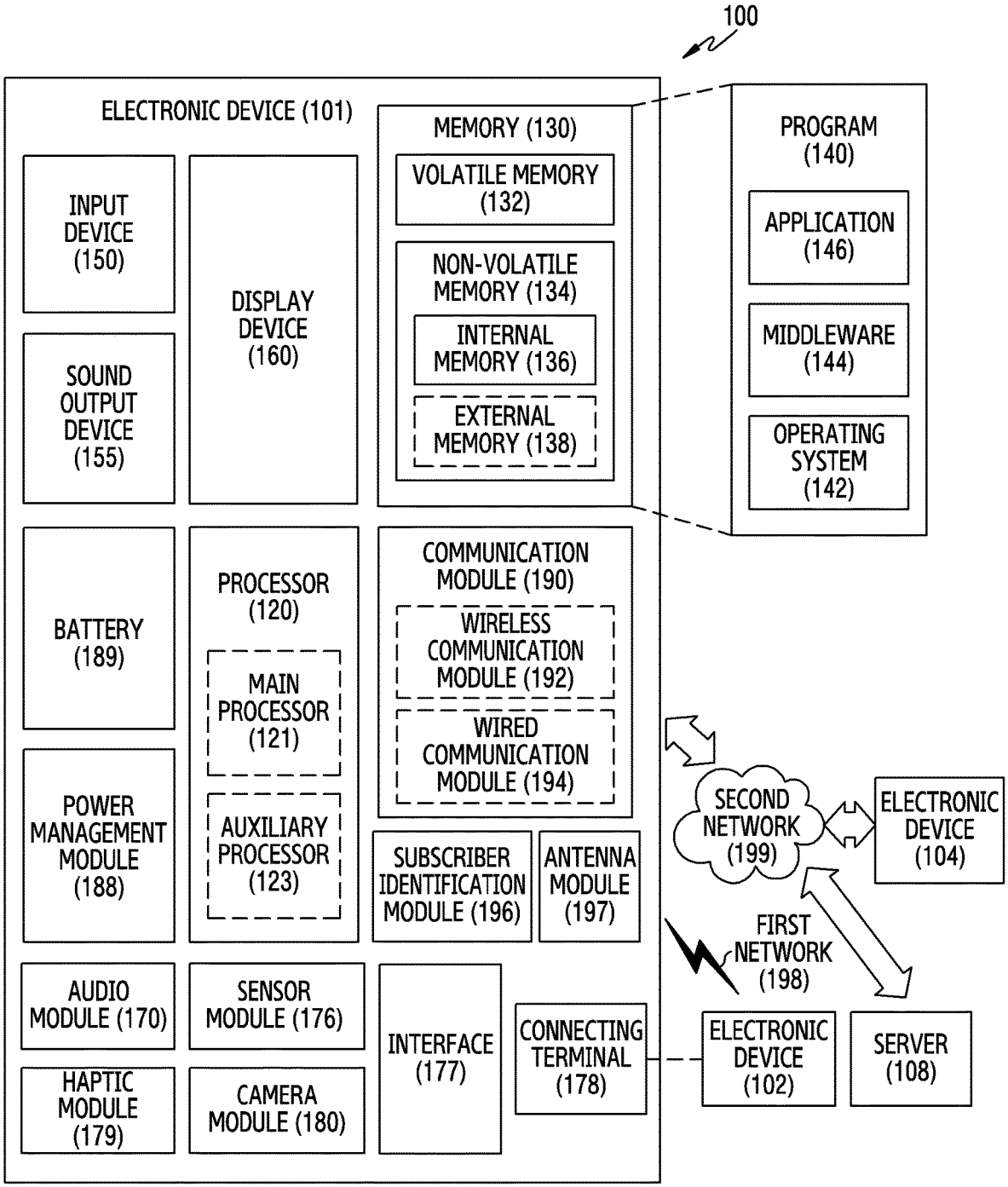
FIG. 1 is a block diagram of an electronic device in a network environment according to an embodiment of the disclosure.

FIG. 1 is a block diagram illustrating an electronic device in a network environment according to an embodiment of the disclosure.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally, or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming call. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high-definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture an image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., printed circuit board (PCB)). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
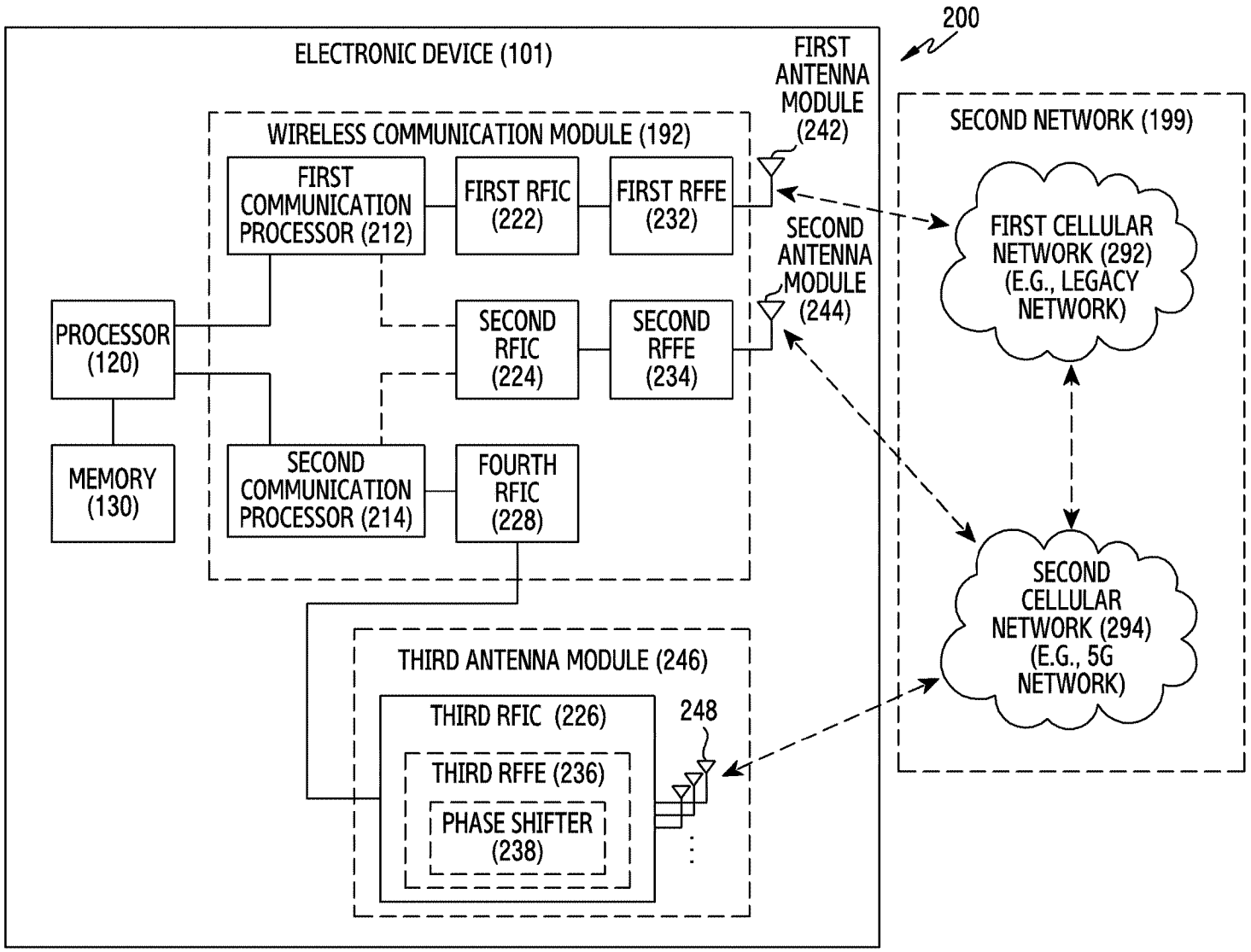
FIG. 2 is a block diagram of an electronic device in a network environment including a plurality of cellular networks according to an embodiment of the disclosure.

FIG. 2 is a block diagram illustrating an example electronic device in a network environment including a plurality of cellular networks according to an embodiment of the disclosure.

Referring to FIG. 2, block diagram 200 depicts an electronic device 101 which may include a first communication processor (e.g., including processing circuitry) 212, a second communication processor (e.g., including processing circuitry) 214, a first radio frequency integrated circuit (RFIC) 222, a second RFIC 224, a third RFIC 226, a fourth RFIC 228, a first radio frequency front end (RFFE) 232, a second RFFE 234, a first antenna module 242, a second antenna module 244, and an antenna 248. The electronic device 101 may further include a processor (e.g., including processing circuitry) 120 and a memory 130. The second network 199 may include a first cellular network 292 and a second cellular network 294. According to another embodiment, the electronic device may further include at least one of the parts shown in FIG. 1 and the second network 199 may further include at least one another network. According to an embodiment, the first communication processor 212, the second communication processor 214, the first RFIC 222, the second RFIC 224, the fourth RFIC 228, the first RFFE 232, and the second RFFE 234 may form at least a portion of a wireless communication module 192. According to another embodiment, the fourth RFIC 228 may be omitted or may be included as a portion of the third RFIC 226.

The first communication processor 212 can support establishment of a communication channel with a band to be used for wireless communication with the first cellular network 292 and legacy network communication through the established communication channel According to various embodiments, the first cellular network may be a legacy network including a $2^{nd}$ generation (2G), $3^{rd}$ generation (3G), $4^{th}$ generation (4G), or Long Term Evolution (LTE) network. The second communication processor 214 can support establishment of a communication channel corresponding to a designated band (e.g., about 6 GHz~about 60 GHz) of a band to be used for wireless communication with the second cellular network 294 and $5^{th}$ generation (5G) network communication through the established communication channel According to various embodiments, the second cellular network 294 may be a 5G network that is defined in 3rd generation partnership project (3GPP). Further, according to an embodiment, the first communication processor 212 or the second communication processor 214 can support establishment of a communication channel corresponding to another designated band (e.g., about 6 GHz or less) of a band to be used for wireless communication with the second cellular network 294 and 5G network communication through the established communication channel According to an embodiment, the first communication processor 212 and the second communication processor 214 may be implemented in a single chip or a single package. According to various embodiments, the first communication processor 212 or the second communication processor 214 may be disposed in a single chip or a single package together with the processor 120, the auxiliary processor 123, or the communication module 190. According to an embodiment, the first communication processor 212 and the second communication processor 214 is directly or indirectly connected by an interface (not shown), thereby being able to provide or receive data or control signal in one direction or two directions.

The first RFIC 222, in transmission, can converts a baseband signal generated by the first communication processor 212 into a radio frequency (RF) signal of about 700 MHz to about 3 GHz that is used for the first cellular network 292 (e.g., a legacy network). In reception, an RF signal can be obtained from the first cellular network 292 (e.g., a legacy network) through an antenna (e.g., the first antenna module 242) and can be preprocessed through an RFFE (e.g., the first RFFE 232). The first RFIC 222 can covert the preprocessed RF signal into a baseband signal so that the preprocessed RF signal can be processed by the first communication processor 212.

The second RFIC 224 can convert a baseband signal generated by the first communication processor 212 or the second communication processor 214 into an RF signal in a Sub6 band (e.g., about 6 GHz or less) (hereafter, 5G Sub6 RF signal) that is used for the second cellular network 294 (e.g., a 5G network). In reception, a 5G Sub6 RF signal can be obtained from the second cellular network 294 (e.g., a 5G network) through an antenna (e.g., the second antenna module 244) and can be preprocessed through an RFFE (e.g., the second RFFE 234). The second RFIC 224 can convert the processed 5G Sub6 RF signal into a baseband signal so that the processed 5G Sub6 RF signal can be processed by a corresponding communication processor of the first communication processor 212 or the second communication processor 214.

The third RFIC 226 can convert a baseband signal generated by the second communication processor 214 into an RF signal in a 5G Above6 band (e.g., about 6 GHz~about 60 GHz) (hereafter, 5G Above6 RF signal) that is used for the second cellular network 294 (e.g., a 5G network). In reception, a 5G Above6 RF signal can be obtained from the second cellular network 294 (e.g., a 5G network) through an antenna (e.g., the antenna 248) and can be preprocessed through the third RFFE 236. The third RFIC 226 can covert the preprocessed 5G Above6 RF signal into a baseband signal so that the preprocessed 5G Above6 RF signal can be processed by the second communication processor 214. According to an embodiment, the third RFFE 236 may be provided as a portion of the third RFIC 226.

The electronic device 101, according to an embodiment, may include a fourth RFIC 228 separately from or as at least a portion of the third RFIC 226. In this case, the fourth RFIC 228 can convert a baseband signal generated by the second communication processor 214 into an RF signal in an intermediate frequency band (e.g., about 9 GHz~about 11 GHz) (hereafter, IF signal), and then transmit the IF signal to the third RFIC 226. The third RFIC 226 can convert the IF signal into a 5G Above6 RF signal. In reception, a 5G Above6 RF signal can be received from the second cellular network 294 (e.g., a 5G network) through an antenna (e.g., the antenna 248) and can be converted into an IF signal by the third RFIC 226. The fourth RFIC 228 can covert the IF signal into a baseband signal so that IF signal can be processed by the second communication processor 214.

According to an embodiment, the first RFIC 222 and the second RFIC 224 may be implemented as at least a portion of a single chip or a single package. According to an embodiment, the first RFFE 232 and the second RFFE 234 may be implemented as at least a portion of a single chip or a single package. According to an embodiment, at least one of the first antenna module 242 or the second antenna module 244 may be omitted, or may be combined with another antenna module and can process RF signals in a plurality of bands.

According to an embodiment, the third RFIC 226 and the antenna 248 may be disposed on a substrate, thereby being able to form a third antenna module 246. For example, the wireless communication module 192 or the processor 120 may be disposed on a first substrate (e.g., a main PCB). In this case, the third RFIC 226 may be disposed in a partial area (e.g., the bottom) and the antenna 248 may be disposed in another partial area (e.g., the top) of a second substrate (e.g., a sub PCB) that is different from the first substrate, thereby being able to form the third antenna module 246. By disposing the third RFIC 226 and the antenna 248 on the same substrate, it is possible to reduce the length of the transmission line therebetween. Accordingly, it is possible to reduce a loss (e.g., attenuation) of a signal in a high-frequency band (e.g., about 6 GHz about 60 GHz), for example, which is used for 5G network communication, due to a transmission line. Accordingly, the electronic device 101 can improve the quality and the speed of communication with the second cellular network 294 (e.g., 5G network).

According to an embodiment, the antenna 248 may be an antenna array including a plurality of antenna elements that can be used for beamforming. In this case, the third RFIC 226, for example, as a portion of the third RFFE 236, may include a plurality of phase shifters 238 corresponding to the antenna elements. In transmission, the phase shifters 238 can convert the phase of a 5G Above6 RF signal to be transmitted to the outside of the electronic device 101 (e.g., to a base station of a 5G network) through the respectively corresponding antenna elements. In reception, the phase shifters 238 can convert the phase of a 5G Above6 RF signal received from the outside through the respectively corresponding antenna element into the same or substantially the same phase. This facilitates transmission or reception through beamforming between the electronic device 101 and the outside.

The second cellular network 294 (e.g., a 5G network) may be operated independently from (e.g., Stand-Along (SA)) or connected and operated with (e.g., Non-Stand Along (NSA)) the first cellular network 292 (e.g., a legacy network). For example, there may be only an access network (e.g., a 5G radio access network (RAN) or a next generation RAN (NG RAN)) and there is no core network (e.g., a next generation core (NGC)) in a 5G network. In this case, the electronic device 101 can access the access network of the 5G network and then can access an external network (e.g., the internet) under control by the core network (e.g., an evolved packed core (EPC)) of the legacy network. Protocol information (e.g., LTE protocol information) for communication with a legacy network or protocol information (e.g., New Radio (NR) protocol information) for communication with a 5G network may be stored in the memory 230 and accessed by another part (e.g., the processor 120, the first communication processor 212, or the second communication processor 214).

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively, or additionally, a plurality of components (e.g., modules or programs) may be integrated into a single component. In such a case, according to various embodiments, the integrated component may perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 3A:
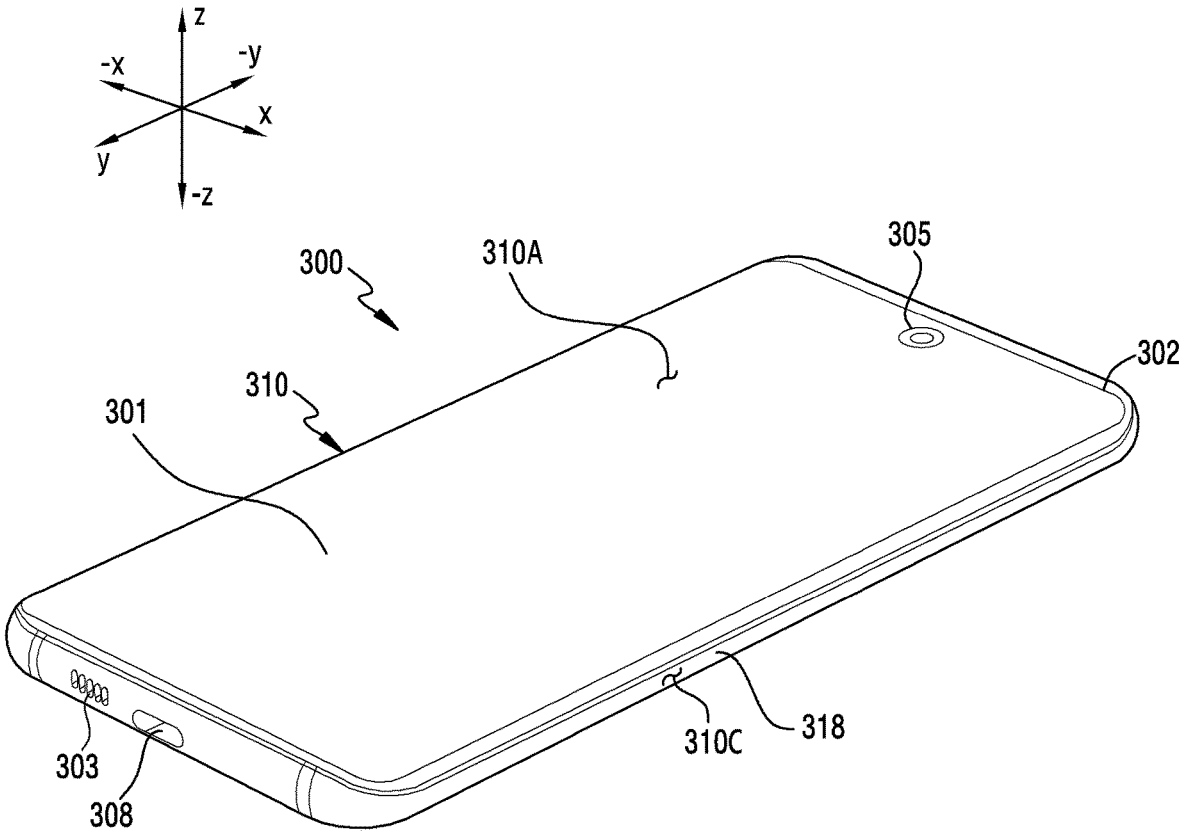
FIG. 3A is a perspective view showing a front surface of an electronic device according to an embodiment of the disclosure.

FIG. 3A is a perspective view showing a front surface of an electronic device according to an embodiment of the disclosure.

Figure 3B:
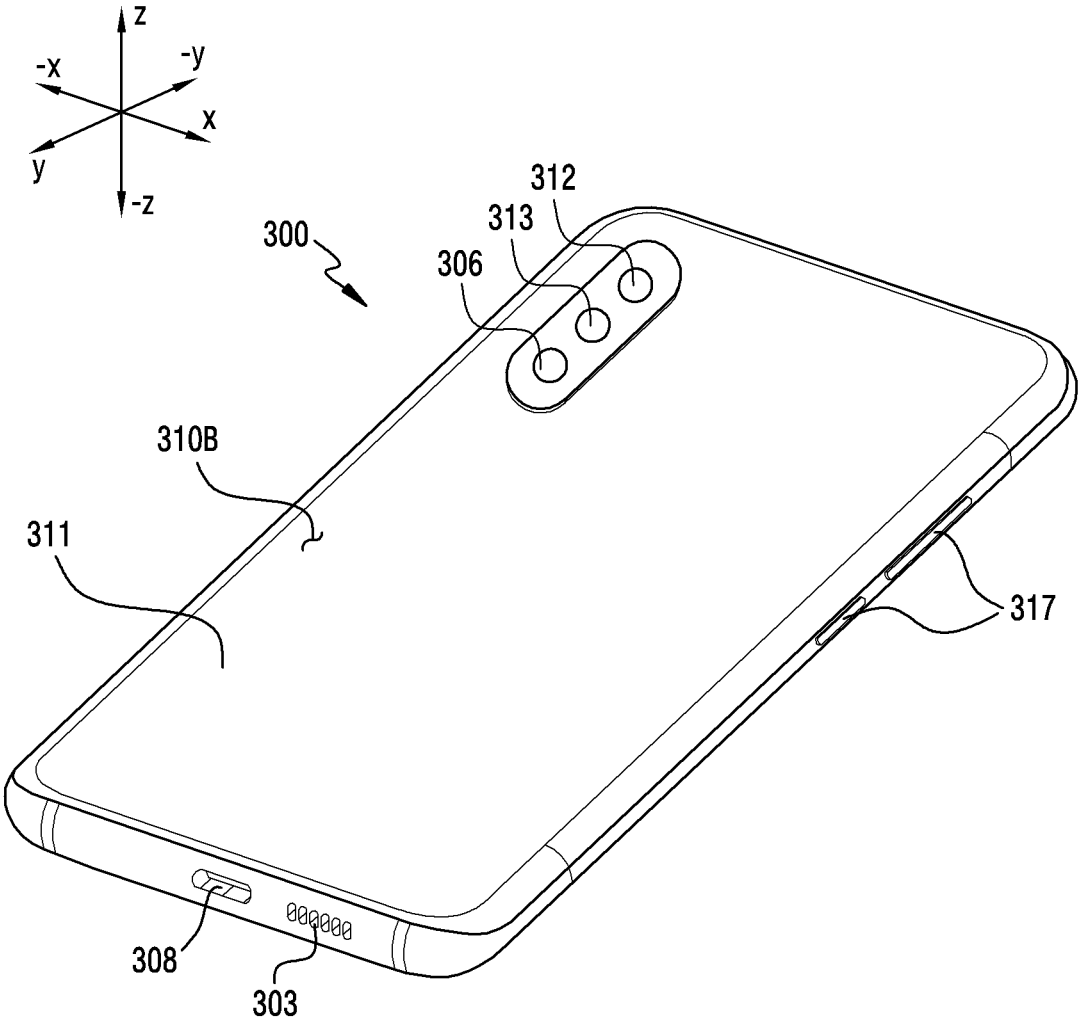
FIG. 3B is a perspective view showing a rear surface of an electronic device shown in FIG. 3A according to an embodiment of the disclosure.

FIG. 3B is a perspective view showing a rear surface of an electronic device shown in FIG. 3A according to an embodiment of the disclosure.

Referring to FIGS. 3A and 3B, an electronic device 300 (e.g., the electronic device 101 shown in FIGS. 1 and 2) according to various embodiments may include a housing 310 having a first surface (or a front surface) 310A, a second surface (or a rear surface) 310B, and a side surface (or a side wall) 310C surrounding the space between the first surface 310A and the second surface 310B. In another embodiment (not shown), the housing may mean a structure forming some of the first surface 310A, the second surface 310B, and the side surface 310C shown in FIGS. 3A and 3B.

According to an embodiment, the first surface 310A may be at least partially substantially formed by a transparent front plate 302 (e.g., a glass plate or a polymer plate including various coating layers). Depending on embodiments, the front plate 302 may have a curved portion bending and seamlessly extending from the first surface 310A to a rear plate 311 at least at a side edge portion.

According to various embodiments, the second surface 310B may be formed by the rear plate 311 that is substantially opaque. The rear plate 311, for example, may be made of coated or colored glass, ceramic, a polymer, metal (e.g., aluminum, stainless steel (STS), or magnesium), or a combination of at least two of these materials. Depending on embodiments, the rear plate 311 may have a curved portion bending and seamlessly extending from the second surface 310B to the front plate 302 at least at a side edge portion.

According to an embodiment, the side surface 310C is combined with a front plate 302 and a rear plate 311 and may be formed by a lateral bezel structure 318 (or a "lateral member or a side wall") including metal and/or a polymer. In an embodiment, the rear plate 311 and the lateral bezel structure 318 may be integrated and may include the same material (e.g., a metallic material such as aluminum).

According to various embodiments, the electronic device 300 may include at least one or more of a display 301, an audio module 303, a sensor module (not shown), a camera device 305, 312, 313, and 306, key input devices 317, and a connector hole 308. In an embodiment, the electronic device 300 may not include at least one (e.g., the key input devices 317) of the components or may further include other components. For example, the electronic device 300 may include a sensor module not shown. For example, a sensor such as a proximity sensor or an illumination sensor may be integrated with the display 301 or may be disposed adjacent to the display 301 in an area that is provided by the front plate 302. In an embodiment, the electronic device 300 may further include a light emitting element and the light emitting element may be disposed adjacent to the display 301 in the area that is provided by the front plate 302. The light emitting element, for example, may provide state information of the electronic device 300 in a light type. In another embodiment, the light emitting element, for example, may provide a light source that operates with the operation of the camera device 305. The light emitting element, for example, may include an LED, an IR LED, and a xenon lamp.

The display 301, for example, may be viewable through a large part of the front plate 302. In an embodiment, the edge of the display 301 may be formed substantially in the same shape as the adjacent outline shape (e.g., curved surface) of the front plate 302. In another embodiment (not shown), in order to enlarge the exposed area of the display 301, the gap between the outline of the display 301 and the outline of the front plate 302 may be substantially uniform. In another embodiment (not shown), a recess or an opening may be formed in a portion of a display area of the display 301, and other electronic devices aligned with the recess or the opening such as the camera device 305 and a proximity sensor or an illumination sensor (not shown) may be included.

In another embodiment (not shown), at least one or more of a camera module (e.g., 312 and 313), a fingerprint sensor, a flash may be disposed on the rear surface of the display area of the display 301. In another embodiment, the display 301 may be combined with or disposed adjacent to a touch sensing circuit, a pressure sensor that can measure the intensity (pressure) of a touch, and/or a digitizer that detects a magnetic stylus pen.

The audio module 303 may have a microphone hole or a speaker hole. A microphone for catching external sounds may be disposed in the microphone hole, and in an embodiment, a plurality of microphones may be disposed therein to be able to sense the directions of sounds. In an embodiment, the speaker hole and the microphone hole may be implemented as one hole (e.g., audio module 303) or a speaker may be included without the speaker hole (e.g., a piezo speaker). The speaker hole may have an external speaker hole and receiver hole 314 for telephone conversation.

The electronic device 300 includes the sensor module (not shown), thereby being able to generate an electrical signal or a data value that corresponds to an internal operation state or an external environment state. The sensor module, for example, may further include a proximity sensor disposed on the first surface 310A of the housing 310, a fingerprint sensor integrated with or disposed adjacent to the display 301, and/or a bio sensor (e.g., HRM sensor) disposed on the second surface 310B of the housing 310. The electronic device 300 may further include a sensor module (not shown), for example, at least one of a gesture sensor, a gyro sensor, a barometer sensor, a magnetic sensor, an acceleration sensor, a grip sensor, a color sensor, an IR (Infrared) sensor, a biosensor, a temperature sensor, a humidity sensor, or an illumination sensor.

The camera device 305, 312, 313, and 306 may include a first camera device 305 disposed on the first surface 310A of the electronic device 300, and second camera devices 312 and 313 and/or a flash (e.g., camera device 306) disposed on the second surface 310B. The camera devices 305, 312, and 313 may include one or more lenses, an image sensor, and/or an image signal processor. A flash (e.g., camera device 306), for example, may include a light emitting diode or a xenon lamp. In an embodiment, two or more lenses (an infrared camera, a wide-angle lens, and a telephoto lens) and image sensors may be disposed on one surface of the electronic device 300.

The key input devices 317 may be disposed on the side 310C of the housing 310. In another embodiment, the electronic device 300 may not include some or all of the key input devices 317 described above and the non-included key input devices 317 may be implemented in other types such as software keys on the display 301. In an embodiment, the key input devices may include at least a portion of the fingerprint sensor 316 disposed on the second surface 310B.

The connector hole 308 can accommodate a connector for transmitting and receiving power and/or data to and from an external electronic device, and/or a connector for transmitting and receiving an audio signal to and from an external electronic device. For example, the connector hole 308 may include a USB connector or an earphone jack.

Figure 4:
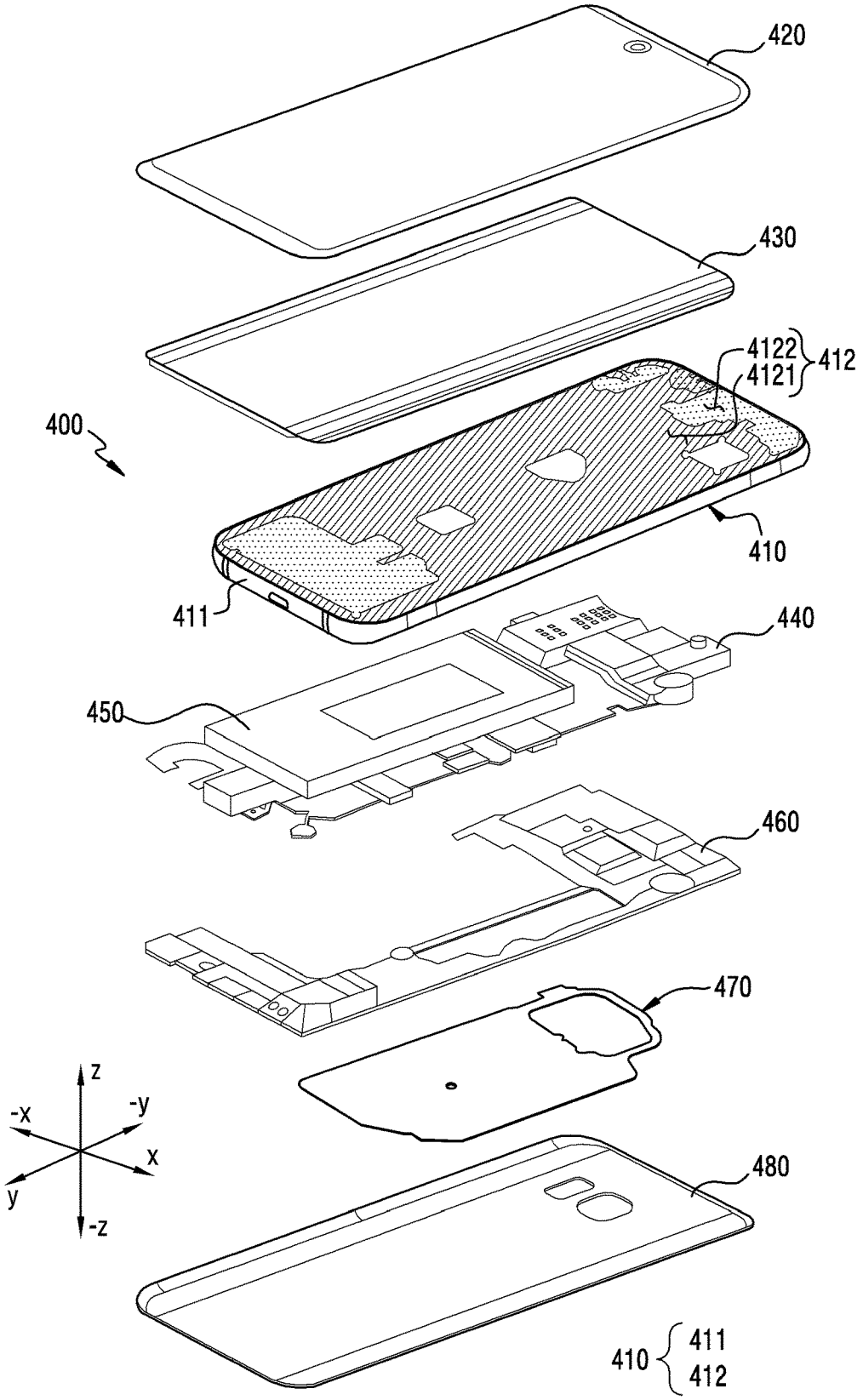
FIG. 4 is an exploded perspective view of an electronic device according to an embodiment of the disclosure.

FIG. 4 is an exploded perspective view of an electronic device according to an embodiment of the disclosure.

Referring to FIG. 4, an electronic device 400 (e.g., the electronic device 300 shown in FIGS. 3A and 3B) according to an embodiment may include a bracket 410, a front plate 420 (e.g., the front plate 302 shown in FIG. 3A), a display 430 (e.g., the display 301 shown in FIG. 3A), a printed circuit board 440, a battery 450, a support member 460 (e.g., a rear case), an antenna 470, and a rear plate 480 (e.g., the rear plate 311 shown in FIG. 3B). Depending on embodiments, the electronic device 400 may not include at least one (e.g., the support member 460) or more of the components or may additionally include other components. At least one of the components of the electronic device 400 according to an embodiment may be the same as or similar to the components of at least one of the electronic device 101 shown in FIG. 1 or 2 or the components of the electronic device 300 shown in FIGS. 3A and 3B, and repeated description is omitted below.

According to an embodiment, the bracket 410 may include a metal frame structure 411 (e.g., the lateral bezel structure 318 shown in FIG. 3A) and a support structure 412. In an embodiment, the metal frame structure 411 is made of a metallic material and may form the side surface (e.g., the side surface 310C shown in FIG. 3A) of the electronic device 400. In an embodiment, the support structure 412 has a metallic region 4121 made of a metallic material and a nonmetallic region 4122 formed by performing injection molding (e.g., insert injection molding) on a nonmetallic material (e.g., a polymer) in at least a portion of the metallic region 4121, and may provide a mounting space in which electronic parts can be disposed in the electronic device 400. For example, the display 430 may be disposed on a surface of the support structure 412 and the printed circuit board 340 may be disposed on another surface of the support structure 412. Depending on embodiments, the support structure 412 may be connected with the metal frame structure 411 or may be integrated with the metal frame structure 411. Though not shown in the figures, at least one antenna module (e.g., the third antenna module 246 shown in FIG. 2) may be disposed inside the metal frame structure 411 or in a partial region of the support member 412, which will be described in detail below.

According to an embodiment, a processor (e.g., the processor 120 shown in FIG. 1), a memory (e.g., the memory 130 shown in FIG. 1), and/or an interface may be disposed on the printed circuit board 440. The processor, for example, may include one or more of a CPU, an application processor, a graphic processor, an image signal processor, a sensor hub processor, or a communication processor. The memory, for example, may include a volatile memory or a nonvolatile memory. The interface may include a High Definition Multimedia Interface (HDMI), a Universal Serial Bus (USB) interface, an SD card interface, and/or an audio interface. The interface, for example, can electrically or physically connect the electronic device 300 to external electronic devices and may include an USB connector, an SD card/MMC connector, or an audio connector.

According to an embodiment, the battery 450, which is a device for supplying power to one or more components of the electronic device 400, for example, may include a primary battery that is not rechargeable, a secondary battery that is rechargeable, or a fuel cell. At least a portion of the battery 450, for example, may be disposed in substantially the same plane as the printed circuit board 340. The battery 450 may be integrally disposed in the electronic device 400 and may be detachably attached to the electronic device 400.

According to an embodiment, the antenna 470 may be disposed between the rear plate 480 and the battery 450. In an embodiment, the antenna 470 may include a Near Field Communication (NFC) antenna, a wireless charging antenna, and/or a Magnetic Secure Transmission (MST) antenna. The antenna 470, for example, can perform near field communication with external devices or can wirelessly transmit and receive power for charging. In another embodiment, an antenna structure may be formed by partial regions of the metal frame structure 411 and/or the support structure 412 or a combination thereof.

In an embodiment, the rear plate 480 may form the rear surface (e.g., the second surface 310B shown in FIG. 3B) of the electronic device 400. The rear plate 480 can protect the electronic device 400 from external shock or foreign substances.

Figure 5:
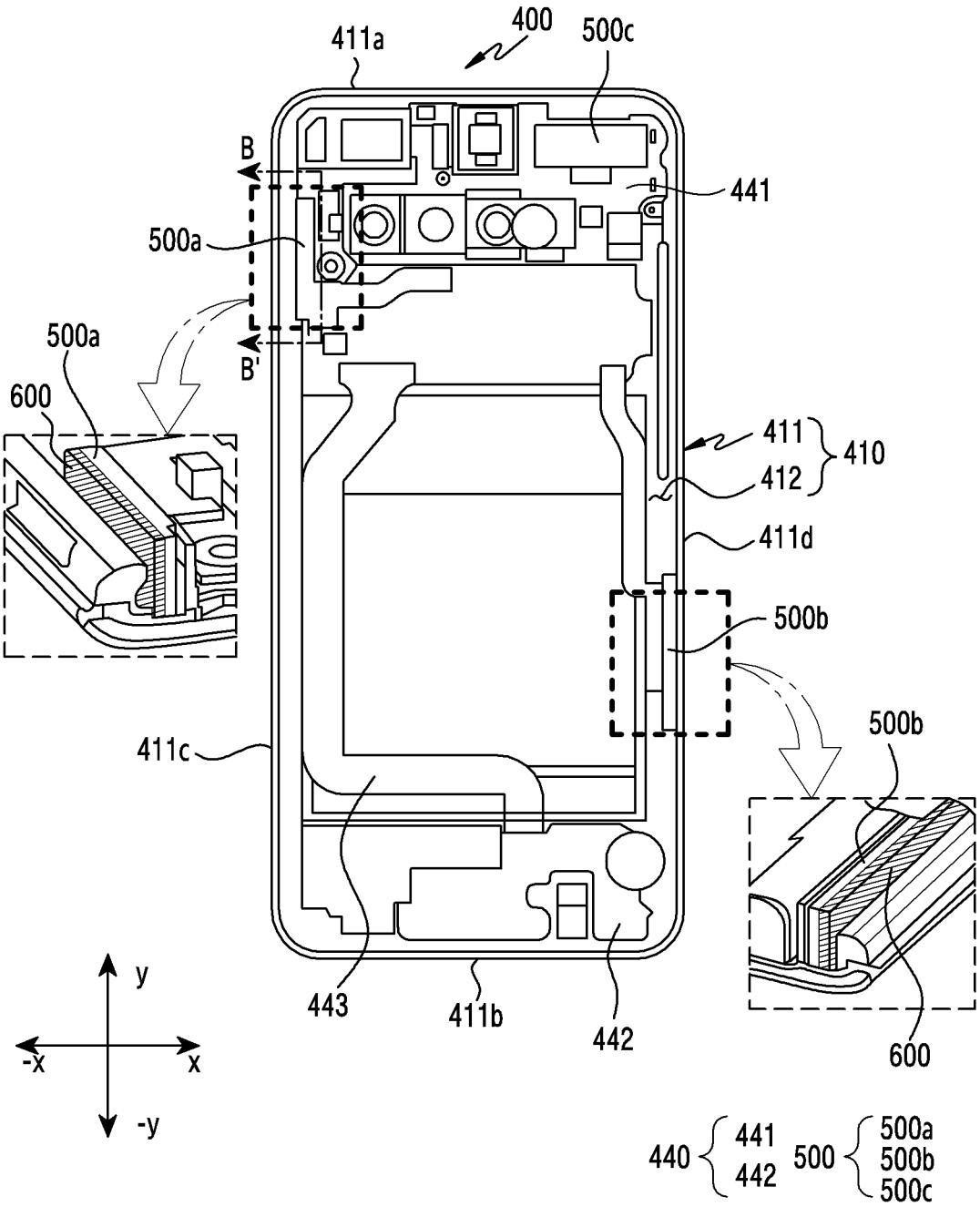
FIG. 5 is a view showing an antenna module disposed in an electronic device according to an embodiment of the disclosure.

FIG. 5 is a view showing an antenna module disposed in an electronic device according to an embodiment of the disclosure.

Referring to FIG. 5, an electronic device 400 including antenna module 500 according to an embodiment (e.g., the electronic device 400 shown in FIG. 4) may include a bracket 410 (e.g., the bracket 410 shown in FIG. 4) including a metal frame structure 411 (e.g., the metal frame structure 411 shown in FIG. 4) and a support structure 412 (e.g., the support structure 412 shown in FIG. 4); a printed circuit board 440 (e.g., the printed circuit board 440 shown in FIG. 4); at least one antenna module 500 (e.g., the third antenna module 246 shown in FIG. 2); and at least one dielectric sheet 600. At least one of the components of the electronic device 400 according to an embodiment may be the same as or similar to at least one of the components of the electronic device 300 shown in FIGS. 3A and 3B and/or the electronic device 400 shown in FIG. 4, and repeated description is omitted below.

According to an embodiment, the metal frame structure 411 of the bracket 410 may have a first edge 411*a*, a second edge 411*b*, a third edge 411*c*, and a fourth edge 411*d* that form the side surface of the electronic device 400. In an embodiment, the first edge 411*a* may be an edge extending along the top of the electronic device 400 (e.g., in y-direction in FIG. 5) and the second edge 411*b* may be an edge extending along the bottom of the electronic device 400 (e.g., in −y-direction) in parallel with the first edge 411*a*. The third edge 411*c* may be an edge that is substantially perpendicular to the first edge 411*a* and/or the second edge 411*b* and extends from an end of the first edge (411*a*) (an end in −x-direction in FIG. 5) to an end of the second edge 411*b* (e.g., an end in −x-direction). The fourth edge 411*d* may be an edge that is parallel with the third edge 411*c* and extends from another end of the first edge 411*a* (e.g., an end in x-direction in FIG. 5) to another end of the second edge 411*b* (e.g., an end in x-direction). In an embodiment, the third edge 411*c* and the fourth edge 411*d* may be longer than the first edge 411*a* and the second edge 411*b*. However, the disclosure is not limited thereto and, depending on embodiments, the first edge 411*a*, the second edge 411*b*, the third edge 411*c*, and the fourth edge 411*d* may have the same length, or the first edge 411*a* and the second edge 411*b* may be longer than the third edge 411*c* and the fourth edge 411*d*.

According to an embodiment, the printed circuit board 440 may be disposed in at least a partial region of the support structure 412 of the bracket 410 and supported by the support structure 412. A processor, a memory, and/or an interface may be disposed on the printed circuit board 440. In an embodiment (not shown), the printed circuit board 440 may be one substrate formed in a ¬-shape or a ⊏-shape. However, the disclosure is not limited to the embodiment described above, and the printed circuit board 440 may include a first printed circuit board 441 and a second printed circuit board 442. The first printed circuit board 441 may be electrically connected with the second printed circuit board 442 through a connection member 443 (e.g., a B-to-B connector (board-to-board connector).

According to an embodiment, at least one antenna module 500 may be disposed in an internal space defined inside the metal frame structure 411 of the bracket 410. In an embodiment, at least one antenna module 500 may include a first antenna module 500*a*, a second antenna module 500*b*, and a third antenna module 500*c*. According to an embodiment, the first antenna module 500*a* and the second antenna module 500*b* may be vertically mounted in the internal space defined inside the metal frame structure 411 to secure radiation performance and a mounting space for other electronic parts (e.g., the battery 450 shown in FIG. 4) of the electronic device 400. The fact that the antenna module is vertically mounted in the disclosure means that the antenna module is disposed such that the surface (e.g., a radiation surface) having a large width thereof faces the side surface (e.g., the side surface 310C shown in FIG. 3A) of the electronic device 400, and may be used as the same meaning in the following description.

According to an embodiment, the third antenna module 500*c* may be horizontally mounted in a region adjacent to the first edge 411*a*. In this case, the fact that the antenna module is vertically mounted in the disclosure means that the antenna module is disposed such that the surface (e.g., the radiation surface) having a large width thereof faces the rear plate (e.g., the rear plate 480 shown in FIG. 4).

According to an embodiment, at least one dielectric sheet 600 may be attached to the radiation surface of the vertically mounted antenna module (e.g., the first antenna module 500*a* and the second antenna module 500*b*) or may be attached to the inner side of the side surface of the electronic device 400 that faces the radiation surface of the vertically mounted antenna module. The at least one dielectric sheet 600 include a dielectric sheet having a low permittivity and a dielectric sheet having a high permittivity, thereby being able to improve the radiation performance of the antenna module (e.g., the first antenna module 500*a* and the second antenna module 500*b*) and efficiently dissipate heat generated by the antenna module. However, the configuration and effect of the at least one dielectric sheet 600 will be described in detail below.

Figure 6A:
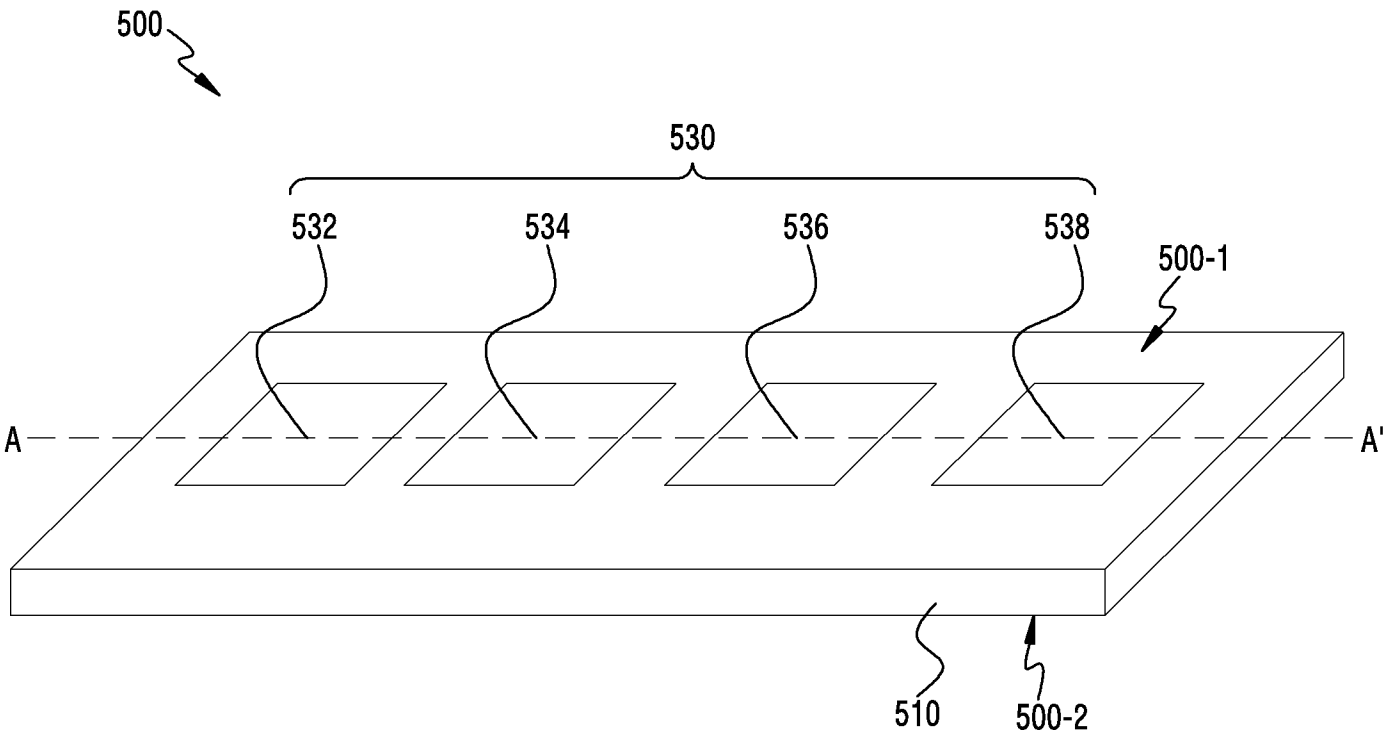
FIG. 6A is a perspective view showing an antenna module according to an embodiment seen from a side according to an embodiment of the disclosure.

FIG. 6A is a perspective view showing an antenna module from a side according to an embodiment of the disclosure.

Figure 6B:
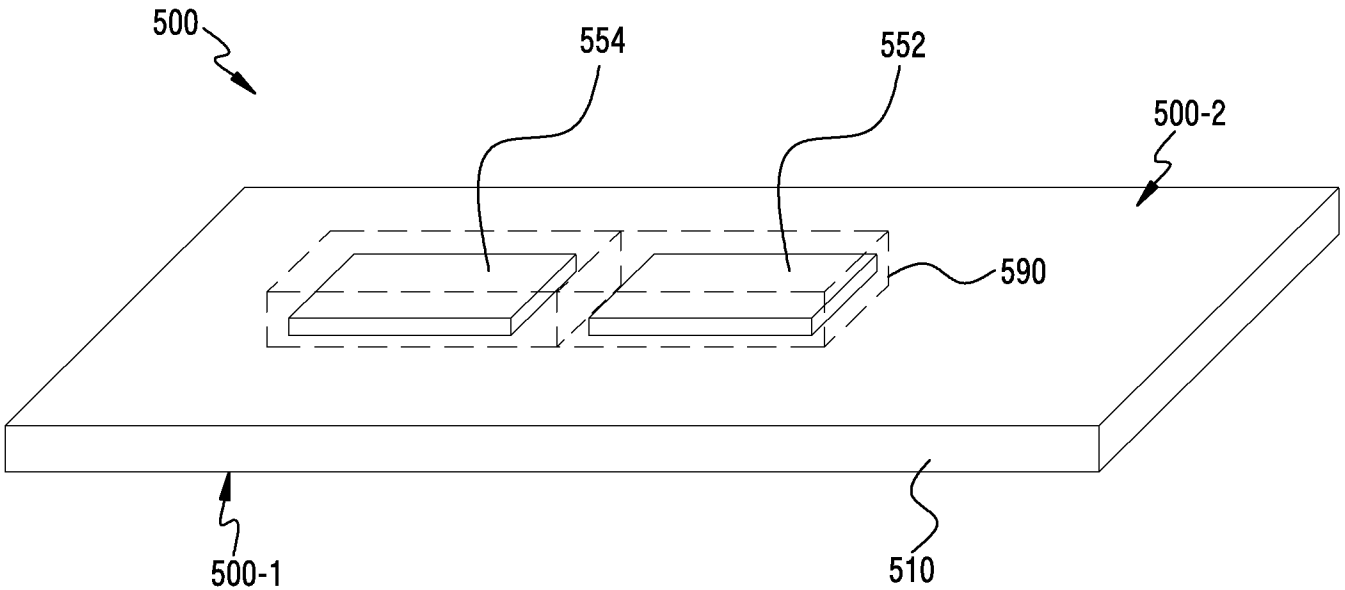
FIG. 6B is a perspective view showing an antenna module shown in FIG. 6A seen from another side according to an embodiment of the disclosure.

FIG. 6B is a perspective view showing an antenna module shown in FIG. 6A from another side according to an embodiment of the disclosure.

Figure 6C:
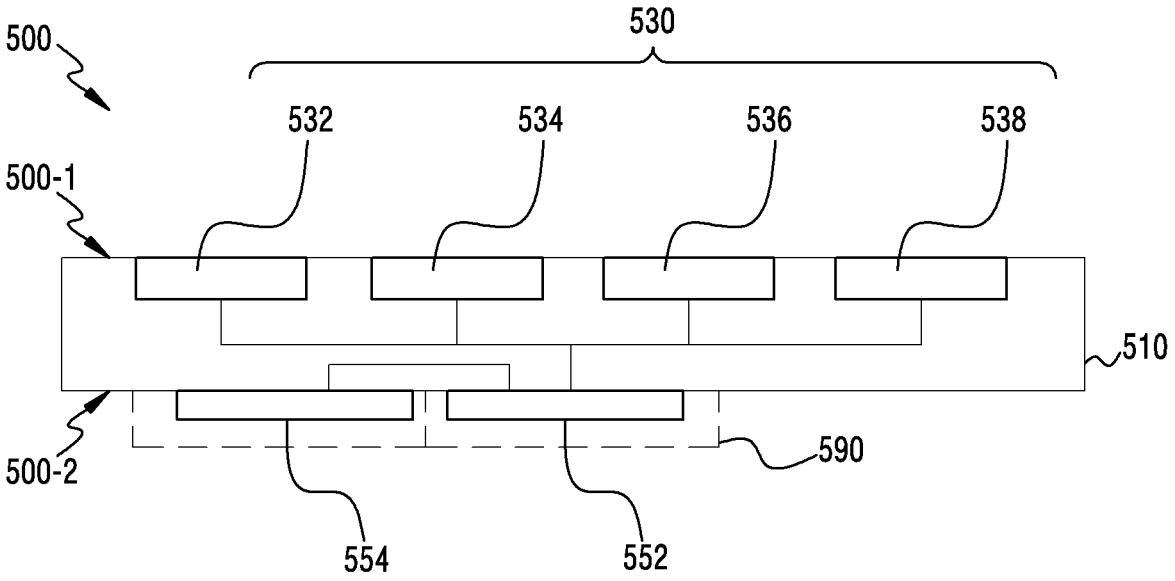
FIG. 6C is a cross-sectional view of an antenna module shown in FIG. 6A taken along line A-A' according to an embodiment of the disclosure.

FIG. 6C is a cross-sectional view of an antenna module shown in FIG. 6A taken along line A-A' according to an embodiment of the disclosure. FIGS. 6A to 6C show an embodiment of the structure of the at least one antenna module 500 shown in FIG. 5 in the disclosure.

Referring to FIGS. 6A, 6B, and 6C, at least one antenna module 500 may include a printed circuit board 510, an antenna array 530, a Radio Frequency Integrated Circuit (RFIC) 552, a Power Manage Integrated Circuit 554 (PMIC), and a module interface 570. Depending on embodiment, the at least one antenna module 500 may further include a shielding member 590 other than the configuration described above.

According to an embodiment, the printed circuit board 510 may include a plurality of conductive layers and a plurality of non-conductive layers alternately stacked with the conductive layers. The printed circuit board 510 can provide electrical connection between various electronic parts disposed on the printed circuit board 510 and/or disposed outside using wires and conductive vias formed in the conductive layers.

According to an embodiment, an antenna array 530 (e.g., 248 in FIG. 2) may include a plurality of antenna elements 532, 534, 536, or 538 disposed to form directional beams. The antenna elements 532, 534, 536, or 538, as shown in FIG. 6, may be disposed on a first surface 500-1 (or a radiation surface) of the printed circuit board 510. According to another embodiment, the antenna array 530 may be disposed in the printed circuit board 510. According to an embodiment, the antenna array 530 may include a plurality of antenna arrays having the same or different shapes or kinds (e.g., patch antenna array and/or dipole antenna arrays).

According to an embodiment, the RFIC 552 (e.g., the third RFIC 226 shown in FIG. 2) may be disposed in another region (e.g., on a second surface 500-2 opposite to the first surface) spaced apart from the antenna array 530 of the printed circuit board 510. The RFIC 552 described above may be configured to be able to process signals in a predetermined frequency band transmitted or received through the antenna array 530. According to an embodiment, the RFIC 552, in transmitting, can convert a signal in a base band acquired from a communication processor (not shown) into an RF signal in a predetermined band. Further, the RFIC 552, in receiving, can convert an RF signal received through the antenna array 530 into a signal in the base band and then can transmit the converted signal to the communication processor.

According to another embodiment, the RFIC 552, in transmitting, can up-convert an IF signal (e.g., about 9 GHz to about 11 GHz) acquired from an Intermediate Frequency Integrate Circuit (IFIC) (e.g., the fourth RFIC 228 shown in FIG. 2) into an RF signal in a selected band. Further, the RFIC 552, in receiving, can down-convert an RF signal received through the antenna array 530 into an IF signal and then can transmit the converted signal to the IFIC described above.

According to an embodiment, the PMIC 554 may be disposed in another region (e.g., on the second surface 500-2 of the printed circuit board 510 described above) spaced apart from the antenna array 530 of the printed circuit board 510. The PMIC can be supplied with voltage from a main PCB (not shown) and can provide necessary power to various parts (e.g., the RFIC 552) of the antenna module.

According to an embodiment, the shielding member 590 may be disposed in a portion of the printed circuit board 510 (e.g., on the second surface 500-2 of the printed circuit board 510 described above) to electromagnetically shield at least one of the RFIC 552 or the PMIC 554. According to an embodiment, the shielding member 590 may include a shield can.

Though not shown, in various embodiments, the at least one antenna module 500 may be electrically connected with another printed circuit board (e.g., the first printed circuit board 441 shown in FIG. 5) through a module interface. The module interface may include a connection member, for example, a coaxial cable connector, a board-to-board connector, an interposer, or a Flexible Printed Circuit Board (FPCB). The RFIC 552 and/or the PMIC 554 of the at least one antenna module 500 may be electrically connected with another printed circuit board (e.g., the first printed circuit board 441 shown in FIG. 5) through the connection member described above.

Figure 7A:
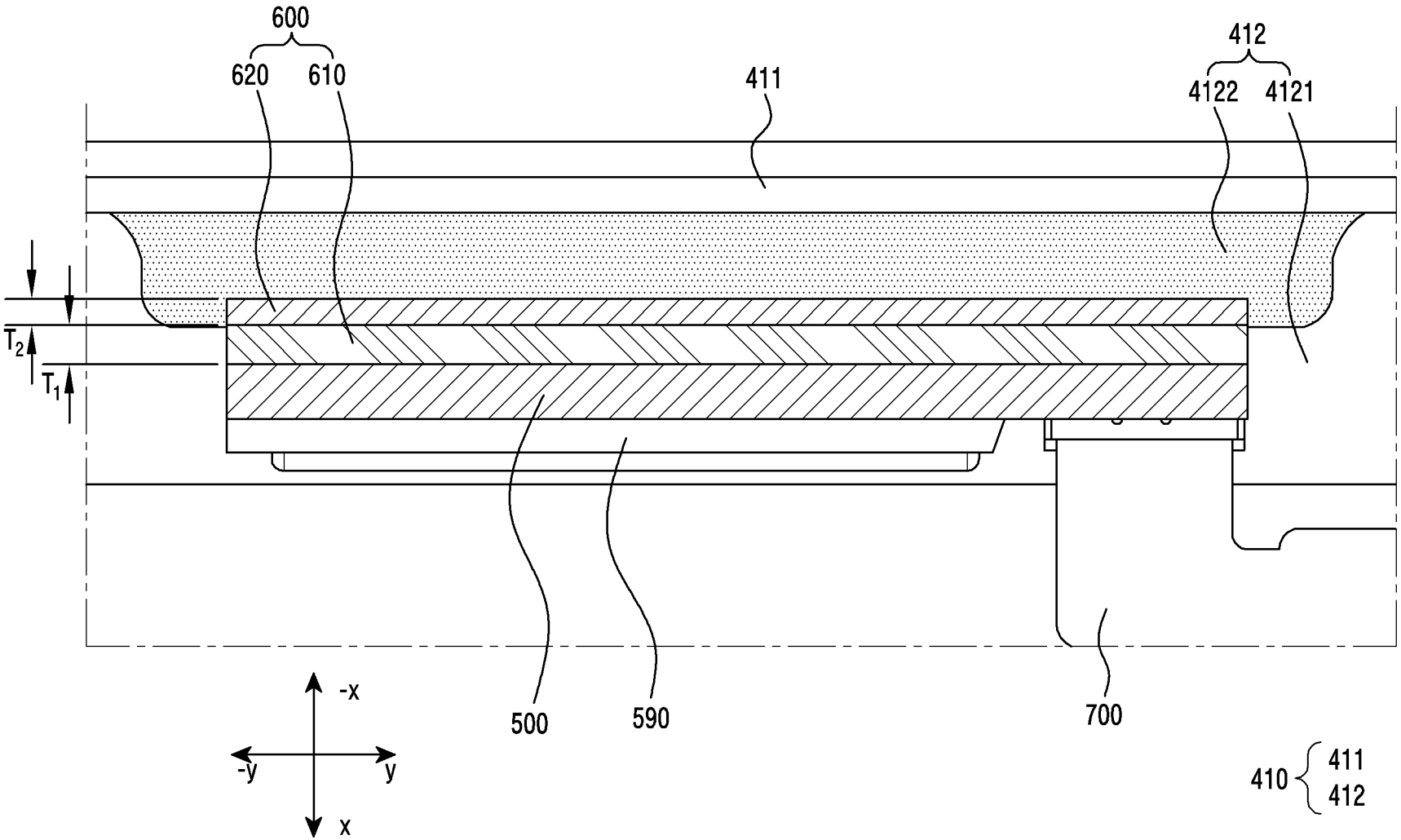
FIG. 7A is a view enlarging an antenna module and a dielectric sheet shown in FIG. 5 according to an embodiment of the disclosure.
Figure 7B:
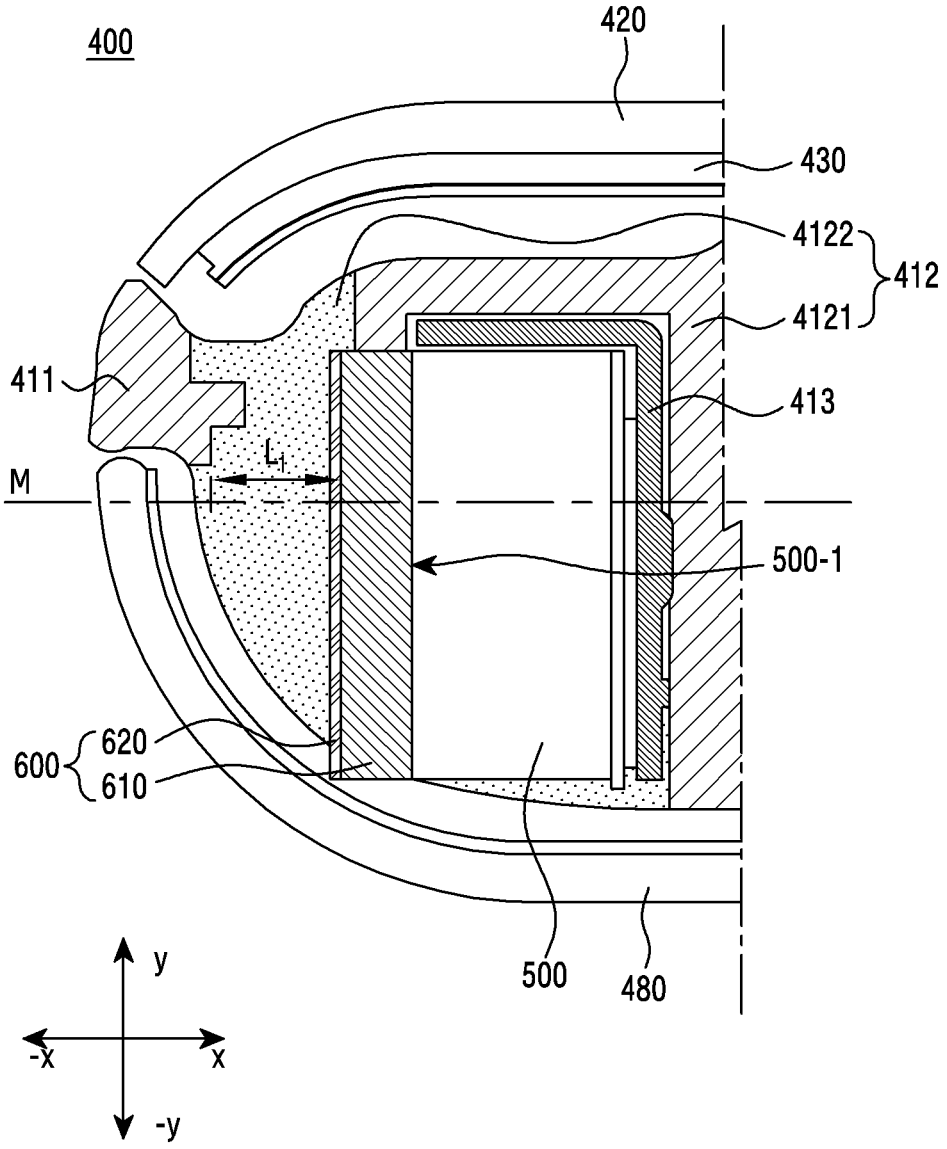
FIG. 7B is a cross-sectional view of an electronic device shown in FIG. 5 taken along line B-B' according to an embodiment of the disclosure.

FIG. 7A is a view enlarging the antenna module and the dielectric sheet shown in FIG. 5 according to an embodiment of the disclosure and FIG. 7B is a cross-sectional view of the electronic device shown in FIG. 5 taken along line B-B' according to an embodiment of the disclosure. FIGS. 7A and 7B are views showing the first antenna module shown in FIG. 5 (e.g., the first antenna module 500*a* shown in FIG. 5) and a dielectric sheet (e.g., the at least one dielectric sheet 600 shown in FIG. 5) attached to the first antenna module, but a dielectric sheet having the same structure may be attached to the second antenna module shown in FIG. 5 (e.g., the second antenna module 500*b* shown in FIG. 5).

Referring to FIGS. 7A and 7B, an electronic device 400 (e.g., the electronic device 400 shown in FIGS. 4 and 5) according to an embodiment may include a bracket 410 (e.g., the bracket 410 shown in FIGS. 4 and 5), a front plate 420 (e.g., the front plate 420 shown in FIG. 4), a display 430 (e.g., the display 430 shown in FIG. 4), a rear plate 480 (e.g., the rear plate 480 shown in FIG. 4), at least one antenna module 500 (e.g., the first antenna module 500 shown in FIG. 5), at least one dielectric sheet 600 (e.g., the at least one dielectric sheet 600 shown in FIG. 5), and an electrical connection member 700. At least one of the components of the electronic device 400 shown in FIGS. 7A and 7B may be the same as or similar to at least one of the components of the electronic device 400 shown in FIG. 4 or 5, and repeated description is omitted below.

According to an embodiment, the bracket 410 is disposed between the front plate 420 and the rear plate 480 and may include a metal frame structure 411 (e.g., the metal frame structure 411 shown in FIG. 4) forming a side surface (e.g., the side surface 310C shown in FIG. 3A) of the electronic device 400; and a support structure (e.g., the support structure 412 shown in FIG. 4) forming a mounting structure for the components of the electronic device 400. When the metal frame structure 411 is disposed on the radiation surface (e.g., first surface 500-1) of the at least one antenna module 500 (e.g., in −x-direction in FIG. 7A), the radiation direction of an antenna beam may be tilted by the metal frame structure 411, so the radiation performance of the antenna module 500 may decrease. In order to reduce the decrease of the radiation performance of the antenna module 500 due to the metal frame structure 411 described above, the metal frame structure 411 according to an embodiment may be biased to the front plate 420 or the rear plate 480 from a virtual center line (e.g., M in FIG. 7B) of the electronic device 400. By the disposed structure of the metal frame structure 411 described above, the region in which the metal frame structure 411 and the radiation surface (e.g., first surface 500-1) of the antenna module 500 overlap each other may decrease, and accordingly, the degree of tilting of the antenna beam due to the metal frame structure 411 may decrease.

According to an embodiment, the at least one antenna module 500 is mounted perpendicular to a partial region or one surface of the support structure 412 facing the metal frame structure 411, whereby it can be disposed inside the metal frame structure 411 forming the side surface of the electronic device 400. As the at least one antenna module 500 is perpendicularly mounted, the radiation surface (e.g., the first surface 500-1 shown in FIG. 6A), on which an antenna array (e.g., the antenna array 530 shown in FIG. 6A) is disposed, of the at least one antenna module 500 may be disposed to face the metal frame structure 411.

In an embodiment, the at least one antenna module 500 may be disposed in a partial region (region A) of the support structure 412 facing the metal frame structure 411 (e.g., a region facing −x-direction in FIGS. 7A and 7B). In an embodiment, the at least one antenna module 500 may be fixed to the metallic region 4121 of the support structure 412 through the metal plate 413. The metal plate 413 described above is disposed between the at least one antenna module 500 and the metallic region 4121 of the support structure 412 and can operate as a heat dissipation plate that dissipate heat generated by the antenna module 500. The metal plate 413, for example, may be made of a copper (Cu) material having high thermal conductivity, but is not limited thereto. In another embodiment (not shown), the at least one antenna module 500 is attached to the metal plate 413 by an adhesive member (e.g., a tape) and a screw is fastened to a partial region of the metal plate 413, whereby the at least one antenna module 500 attached to the metal plate 413 can be fixed to at least a partial region of the metallic region 4121 of the support structure 412. The non-metallic region 4122 of the support structure 412 and at least one dielectric sheet 600 may be disposed between the at least one antenna module 500 and the metal frame structure 411. A decrease of the radiation performance of the metal frame structure 411 can be reduced by the non-metallic region 4122 and the at least one dielectric sheet 600 disposed between the antenna module 500 and the metal frame structure 411, which will be described in detail below.

According to an embodiment, the at least one antenna module 500, as described above, may include an RFIC (e.g., the RFIC 554 shown in FIG. 6B) and a PMIC (e.g., the PMIC 452 shown in FIG. 6B), and the RFIC and/or the PMIC may be electrically isolated by the shielding member 590. The at least one antenna module 500 may be electrically connected with a printed circuit board (e.g., the first printed circuit board 441 shown in FIG. 5) through an electrical connection member 700. The electrical connection member 700, for example, may be a coaxial cable connector, a board-to-board connector, an interposer, or a Flexible Printed Circuit Board (FPCB), but is not limited thereto.

According to an embodiment, the at least one dielectric sheet 600 includes a first dielectric sheet 610 and a second dielectric sheet 620 and may be attached to at least a partial region of the at least one antenna module 500.

According to an embodiment, the first dielectric sheet 610 may be attached to at least a partial region, on which the antenna array (e.g., the antenna array 530 shown in FIG. 6A) is disposed, of the radiation surface (e.g., first surface 500-1) of the at least one antenna module 500. In an embodiment, an adhesive member (not shown) may be attached to at least a partial region of the first dielectric sheet 610, and the first dielectric sheet 610 may be attached to the radiation surface (e.g., first surface 500-1) of the at least one antenna module 500 by the adhesive member.

In an embodiment, the first dielectric sheet 610 may be made of a thermal conductive material having a lower permittivity than the second dielectric sheet 620. The first dielectric sheet 610, for example, may be made of thermal conductive polyimide or polyethylene having specific inductive capacity of 2.5 or less (e.g., specific inductive capacity of 2 to 2.3). In an embodiment, the first dielectric sheet 610 is made of a material having relatively low specific inductive capacity, thereby being able to achieve an effect of forming an air gap between the metal frame structure 411 and the at least one antenna module 500. Accordingly, it is possible to reduce a loss of reflection that is generated on the radiation surface (e.g., first surface 500-1) of the at least antenna module by impedance mismatching. In an embodiment, the first dielectric sheet 610 may have a thickness of 0.5 mm or more (e.g., $T_1$ in FIG. 7A) to achieve the effect of forming an air gap between the metal frame structure 411 and the at least one antenna module 500. However, the disclosure is not limited to the embodiment described above, the thickness $T_1$ of the first dielectric sheet 610 may depend on the size of the at least one antenna module 500. In an embodiment, the first dielectric sheet 610 is made of a thermal conductive material, thereby being able to operate as a heat spreader that dissipates heat that is generated when the antenna module 500 transmits or receives an RF signal.

According to an embodiment, the second dielectric sheet 620 is disposed on one surface facing the metal frame structure 411 of the first dielectric sheet 610 (e.g., one surface in −x-direction in FIG. 7A), thereby being able to reduce a decrease of the radiation performance of the at least one antenna module 500 due to the metal frame structure 411. In an embodiment, the second dielectric sheet 620 may be made of a material having higher specific inductive capacity than the first dielectric sheet 610. The second dielectric sheet 620, for example, may be made of a material having specific inductive capacity of 7 or more. In general, the higher the permittivity of a dielectric sheet, the smaller the wavelength of an electromagnetic wave passing through the dielectric sheet. In an embodiment, the second dielectric sheet 620 is made of a material having relatively high specific inductive capacity, thereby being able to decrease the wavelength of an antenna beam passing through the second dielectric sheet 620. As described above, as the wavelength of an antenna beam passing through the second dielectric sheet 620 decreases, an effect like the at least one antenna module 500 moves away from the metal frame structure 411 toward the center of the electronic device 400 (e.g., in x-direction in FIG. 7B) can be generated. That is, the electronic device 400 according to an embodiment can generate an effect like the antenna module 500 is disposed away from the metal frame structure 411 in comparison to the actual distance (e.g., $L_1$) between the metal frame structure 411 and the at least one antenna module 500, through the second dielectric sheet 620 operating like a lens. By this effect, it is possible to reduce a decrease of the radiation performance of the antenna module 500 due to the metal frame structure 411 in the electronic device 400 according to an embodiment.

In an embodiment, the second dielectric sheet 620 has higher specific inductive capacity than the first dielectric sheet 610, but the thickness $T_2$ of the second dielectric sheet 620 may be smaller than the thickness $T_1$ of the first dielectric sheet 610. For example, the first dielectric sheet 610 may have a thickness of 0.5 mm and the second dielectric sheet 620 may have a thickness of 0.1 mm smaller than that of the first dielectric sheet 610. Since the higher the permittivity of a dielectric sheet, the higher the loss of transmission (e.g., loss tangent) of an antenna beam passing through the dielectric sheet, the second dielectric sheet 620 higher in permittivity than the first dielectric sheet 610 may be formed thinner than the first dielectric sheet 610.

Unlike the embodiment described above in which the at least one dielectric sheet 600 is attached to the at least one antenna module 500, at least one dielectric sheet 600 may be attached to a partial region of the support structure 412 in an electronic device 400 according to another embodiment.

According to another embodiment, the second dielectric sheet 620 may be attached to a partial region of the non-metallic region 4122, which faces the radiation surface (e.g., first surface 500-1) of the at least one antenna module 500, of the support structure 412. In an embodiment, the second dielectric sheet 620 may be attached to a surface of the non-metallic region 4122 facing the radiation surface (e.g., first surface 500-1) of the at least one antenna module 500 through an adhesive member (not shown). According to another embodiment, the first dielectric sheet 610 is disposed between the second dielectric sheet 620 and the at least one antenna module 500, thereby being able to operate as a heat dissipation plate that dissipates heat generated by the antenna module 500.

That is, depending on embodiments, the at least one dielectric sheet 600 may be attached to a partial region of the at least one antenna module 500 or a partial region (the non-metallic region 4122) of the bracket 410, thereby being able to prevent a decrease of the radiation performance of the antenna module 500 and dissipate heat generated by the antenna module 500.

Figure 8A:
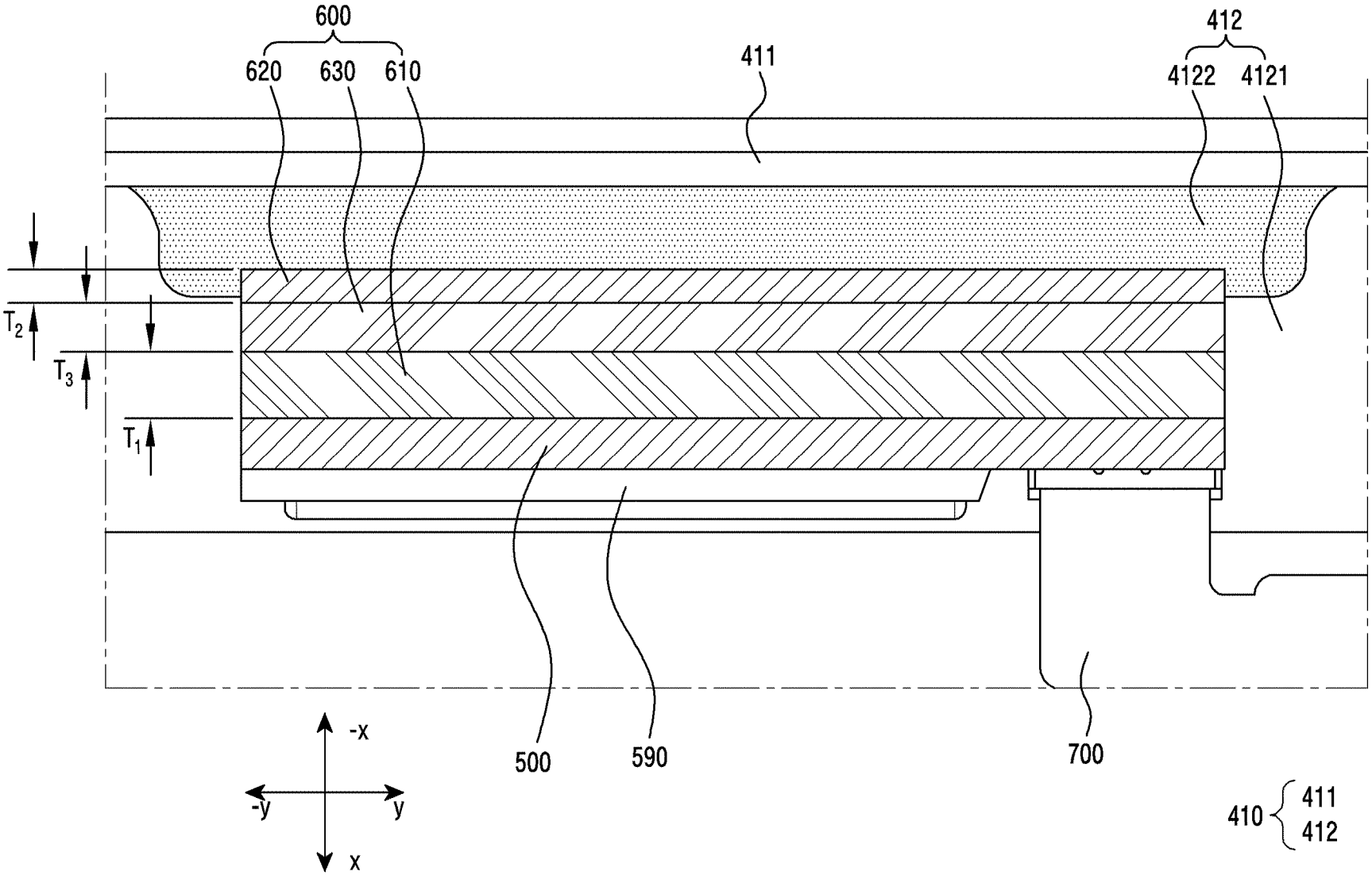
FIG. 8A is a view enlarging an antenna module and a dielectric sheet shown in FIG. 5 according to an embodiment of the disclosure.

FIG. 8A is a view enlarging an antenna module and an dielectric sheet shown in FIG. 5 according to an embodiment of the disclosure.

Figure 8B:
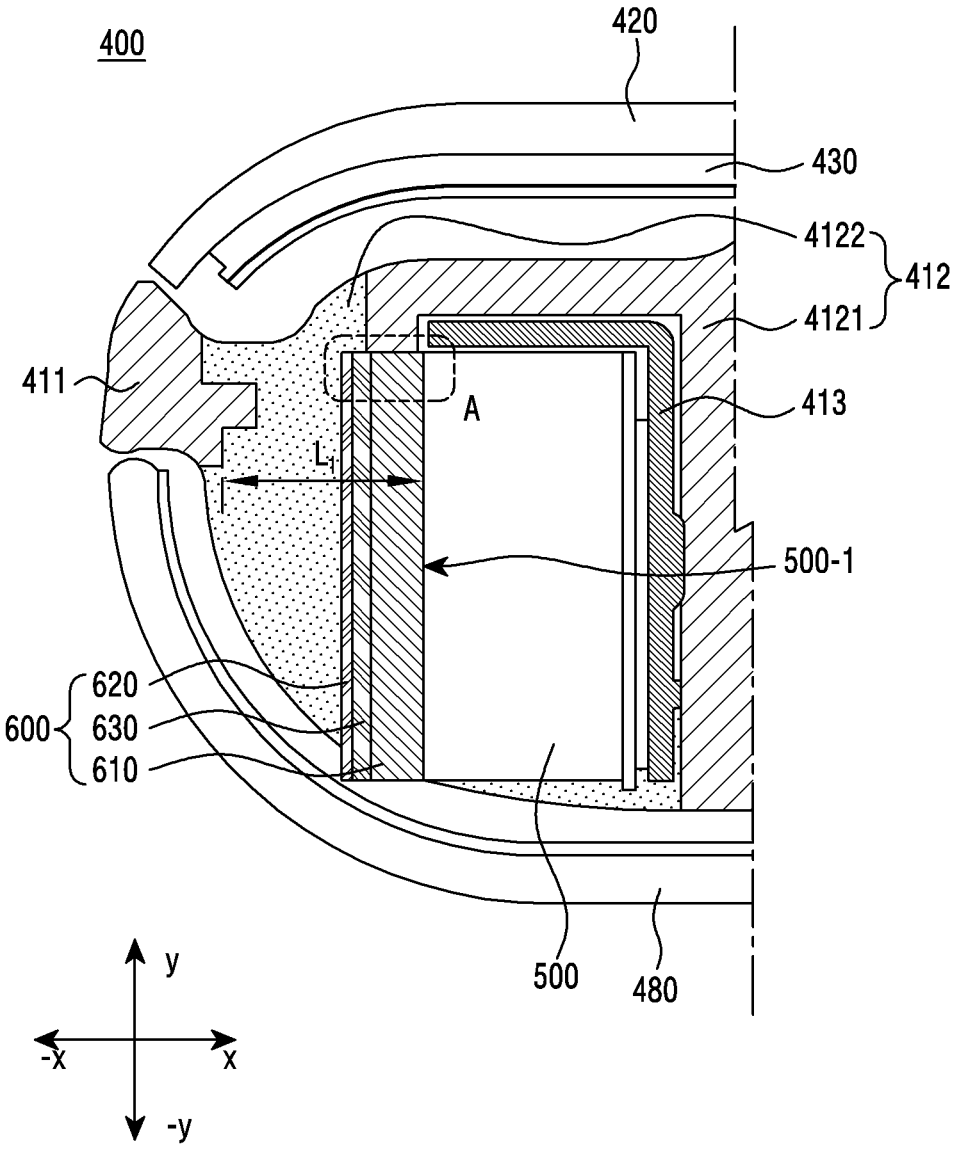
FIG. 8B is a cross-sectional view of an electronic device shown in FIG. 5 taken along line B-B' according to an embodiment of the disclosure.

FIG. 8B is a cross-sectional view of an electronic device shown in FIG. 5 taken along line B-B' according to an embodiment of the disclosure.

Figure 8C:
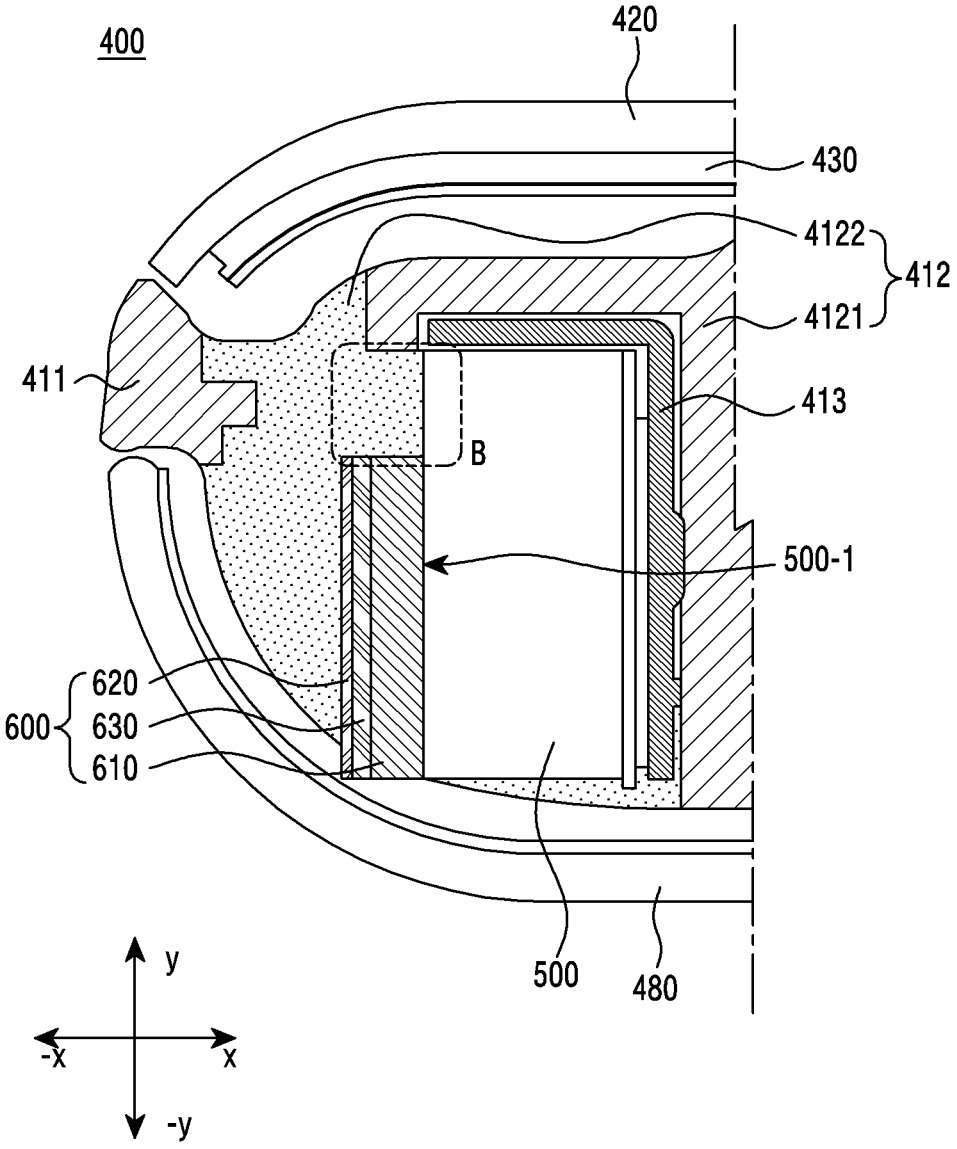
FIG. 8C is a cross-sectional view of an electronic device shown in FIG. 5 taken along line B-B' according to an embodiment of the disclosure.

FIG. 8C is a cross-sectional view of an electronic device shown in FIG. 5 taken along line B-B' according to an embodiment of the disclosure. FIGS. 8A, 8B, and/or 8C is a view showing the first antenna module shown in FIG. 5 (e.g., the first antenna module 500*a* shown in FIG. 5) and a dielectric sheet (e.g., the at least one dielectric sheet 600 shown in FIG. 5) attached to the first antenna module.

Referring to FIGS. 8A, 8B, and 8C, an electronic device 400 according to an embodiment (e.g., the electronic device 400 shown in FIGS. 4 and 5) may include a bracket 410 (e.g., the bracket 410 shown in FIGS. 4 and 5), a front plate 420 (e.g., the front plate 420 shown in FIG. 4), a display 430 (e.g., the display 430 shown in FIG. 4), a rear plate 480 (e.g., the rear plate 480 shown in FIG. 4), at least one antenna module 500 (e.g., at least one antenna module 500 shown in FIGS. 5 and/or 6A, 6B, and 6C), at least one dielectric sheet 600 (e.g., the at least one dielectric sheet 600 shown in FIG. 5), and an electrical connection member 700. The electronic device 400 according to an embodiment may be an electronic device obtained by adding a third dielectric sheet 630 to the electronic device 400 shown in FIGS. 7A and 7B, and repeated description is omitted below.

According to an embodiment, the at least one dielectric sheet 600 may include a first dielectric sheet 610 (e.g., the first dielectric sheet 610 shown in FIG. 7A), a second dielectric sheet 620 (e.g., the second dielectric sheet 620 shown in FIG. 7A), and a third dielectric sheet 630. The at least one dielectric sheet 600, as described above, may be attached to the radiation surface (e.g., first surface 500-1) of the at least one antenna module 500 or may be attached to a partial region of the bracket 410 (e.g., the non-metallic region 4122 of the support structure 412).

The first dielectric sheet 610 according to an embodiment may be disposed on the radiation surface (e.g., first surface 500-1) of the at least one antenna module 500 (e.g., in −x-direction in FIGS. 8A and 8B). The first dielectric sheet 610 described above is made of a thermal conductive material having relatively low specific inductive capacity, thereby being able to generate an effect like an air gap is formed between the at least one antenna module 500 and the metal frame structure 411 and to dissipate heat generated by the antenna module 500.

The second dielectric sheet 620 according to an embodiment may be disposed at a position adjacent to the metal frame structure 411 on the first dielectric sheet 610 (−x-direction in FIGS. 8A and 8B). The second dielectric sheet 620 described above may be made of a material having relatively high specific inductive capacity, thereby being able to decrease the wavelength of an antenna beam passing through the second dielectric sheet 620. Accordingly, it is possible to reduce a decrease of the radiation performance of the antenna module 500 due to the metal frame structure 411.

The third dielectric sheet 630 according to an embodiment may be disposed between the first dielectric sheet 610 and the second dielectric sheet 620. For example, one surface of the third dielectric sheet 630 may be attached to the first dielectric sheet 610 and another surface of the third dielectric sheet 630 may be attached to the second dielectric sheet 620, whereby the third dielectric sheet 630 can be disposed between the first dielectric sheet 610 and the second dielectric sheet 620. That is, the first dielectric sheet 610, the third dielectric sheet 630, and the second dielectric sheet 620 may be sequentially disposed from the at least one antenna module 500 between the at least one antenna module 500 and the metal frame structure 411.

In an embodiment, the third dielectric sheet 630 may be made of a material having specific inductive capacity higher than that of the first dielectric sheet 610 and lower than that of the second dielectric sheet 620. In an embodiment, when the first dielectric sheet 610 is made of a material having specific inductive capacity of 2.5 or less and the second dielectric sheet 620 is made of a material having specific inductive capacity of 7 or more, the third dielectric sheet 630 may be made of a material having specific inductive capacity of 2.5 or more and 7 or less. The third dielectric sheet 630 is made of a material having specific inductive capacity higher than that of the first dielectric sheet 610 and lower than that of the second dielectric sheet 620 between the first dielectric sheet 610 and the second dielectric sheet 620, thereby being able to attenuate a rapid change of a permittivity.

In an embodiment, the thickness $T_3$ of the third dielectric sheet 630 may be smaller than the thickness $T_1$ of the first dielectric sheet 610 and larger than the thickness $T_2$ of the second dielectric sheet 620. However, the disclosure is not limited to the embodiment described above, and a third dielectric sheet 630 according to another embodiment (not shown) may have a thickness the same as that of the first dielectric sheet 610 or the same as that of the second dielectric sheet 620, depending on the frequency band of the RF signal that is transmitted or received by the at least one antenna module 500.

Referring to FIG. 8B, a partial region (e.g., the region A in FIG. 8B) of the at least one dielectric sheet 600 according to an embodiment may be in contact with at least partial region of the metallic region 4121 of the support structure 412. Since a partial region of the first dielectric sheet 610 having thermal conductivity is in contact with the metallic region 4121 of the support structure 412 by the structure described above, the heat generated by the at least one antenna module 500 can spread to the metallic region 4121 through the first dielectric sheet 610, whereby the heat generated by the at least one antenna module 500 can be dissipated.

Referring to FIG. 8C, at least one dielectric sheet 600 according to another embodiment, unlike the at least one dielectric sheet 600 shown in FIG. 8B, may be spaced apart from a partial region of the support structure 412 (see a region B in FIG. 8C). That is, the at least one dielectric sheet 600 may be attached to only a partial region of the radiation surface (e.g., first surface 500-1) of the at least one antenna module 500, whereby a partial region of the at least one dielectric sheet 600 may not be in contact with the metallic region 4121. That is, the at least one dielectric sheet 600, depending on embodiments, may be attached to the entire radiation surface (e.g., first surface 500-1) of the antenna module 500 or may be attached on only a partial region of the radiation surface (e.g., first surface 500-1) of the antenna module 500.

Figure 9A:
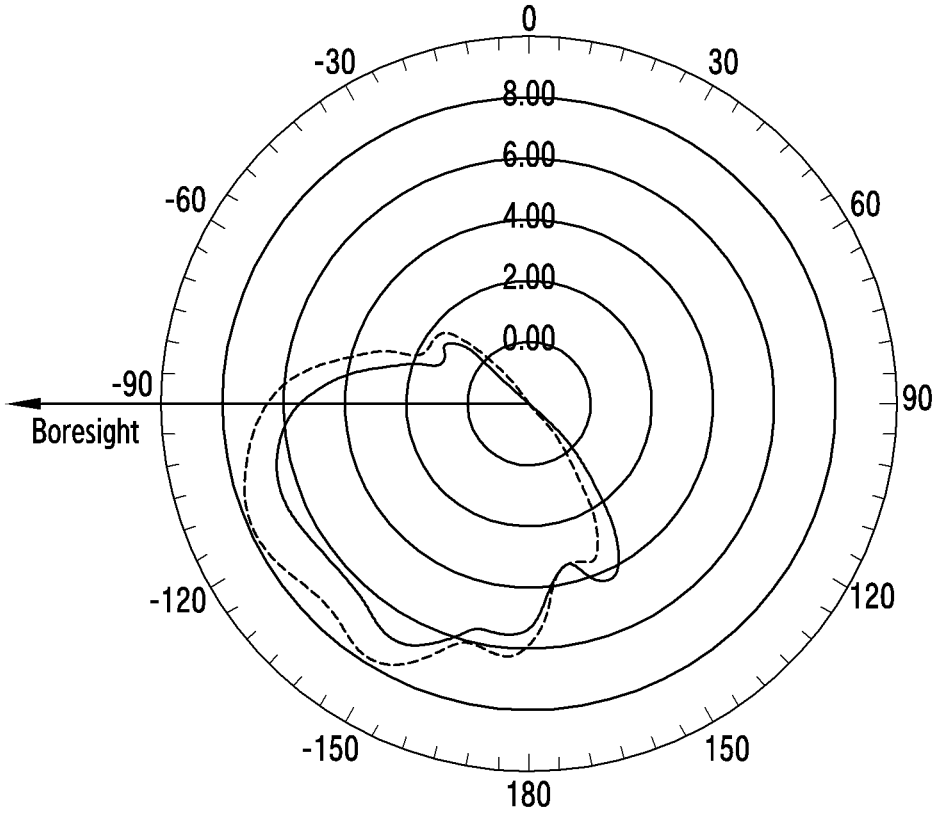
FIG. 9A is a graph comparing radiation direction of an antenna beam according to whether there is a dielectric sheet when a radio frequency (RF) signal in a first frequency band is transmitted or received according to an embodiment of the disclosure.

FIG. 9A is a graph comparing radiation direction of an antenna beam according to whether there is a dielectric sheet when an RF signal in a first frequency band is transmitted or received according to an embodiment of the disclosure.

Figure 9B:
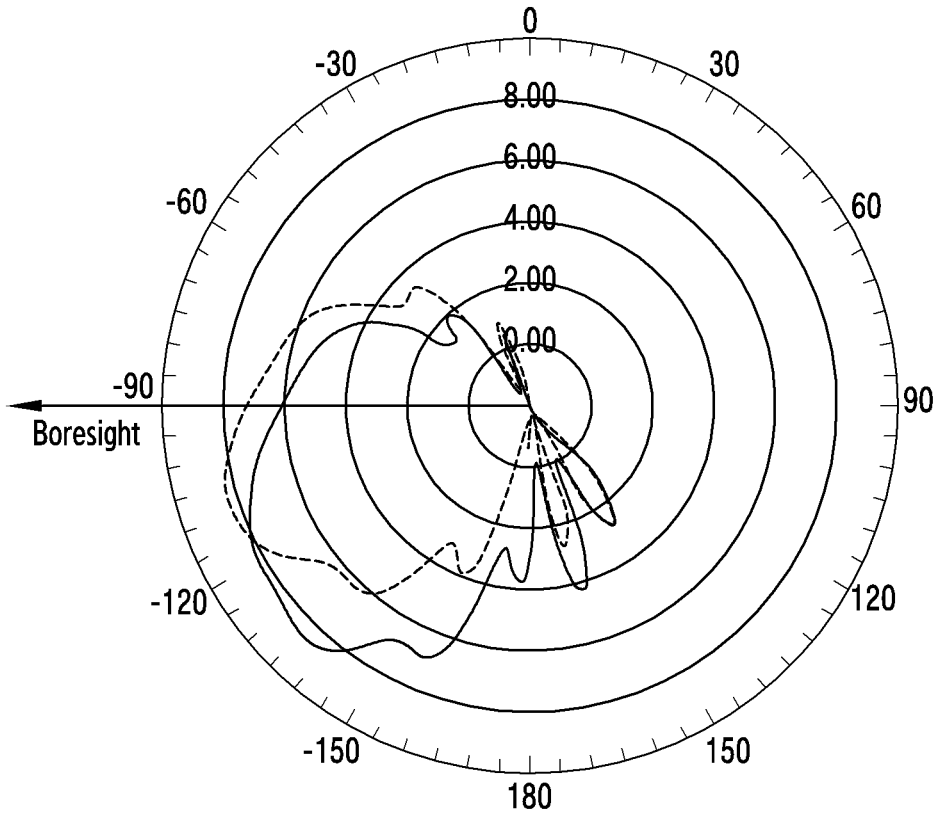
FIG. 9B is a graph comparing radiation direction of an antenna beam according to whether there is a dielectric sheet when an RF signal in a second frequency band is transmitted or received according to an embodiment of the disclosure.

FIG. 9B is a graph comparing radiation direction of an antenna beam according to whether there is a dielectric sheet when an RF signal in a second frequency band is transmitted or received according to an embodiment of the disclosure.

FIG. 9A depicts a graph showing the radiation direction of an antenna beam when an RF signal in a frequency band of 28 GHz is transmitted and/or received through an antenna module (e.g., the at least one antenna module 500 shown in FIGS. 5, 7A, and 8A). Similarly, FIG. 9B depicts a graph showing the radiation direction of an antenna beam when an RF signal in a frequency band of 39 GHz is transmitted and/or received through at least one antenna module. In FIGS. 9A and 9B, the solid line indicates the radiation direction of an antenna beam when a dielectric sheet is not attached to the radiation surface of the antenna module and the dotted line indicates the radiation direction of an antenna beam when a dielectric sheet is attached to the radiation surface of the antenna module (see FIGS. 7A, 7B, 8A, and/or 8B).

Referring to FIGS. 9A and 9B, when a dielectric sheet formed by mixing a dielectric sheet having a low permittivity and a dielectric sheet having the low permittivity is attached to the radiation surface of the antenna module, it can be seen that an antenna beam travels in the boresight direction without tilting in another direction, as compared with when a dielectric sheet is not attached.

Accordingly, it can be seen that it is possible to reduce the influence by the metal frame structure (e.g., the metal frame structure 411 shown in FIGS. 7B and 8B) in the electronic device shown in FIGS. 7A and 7B and/or the electronic device shown in FIGS. 8A and 8B, as compared with an electronic device without a dielectric sheet. Accordingly, it can be seen that a beam coverage in the boresight direction can be secured.

Figure 10A:
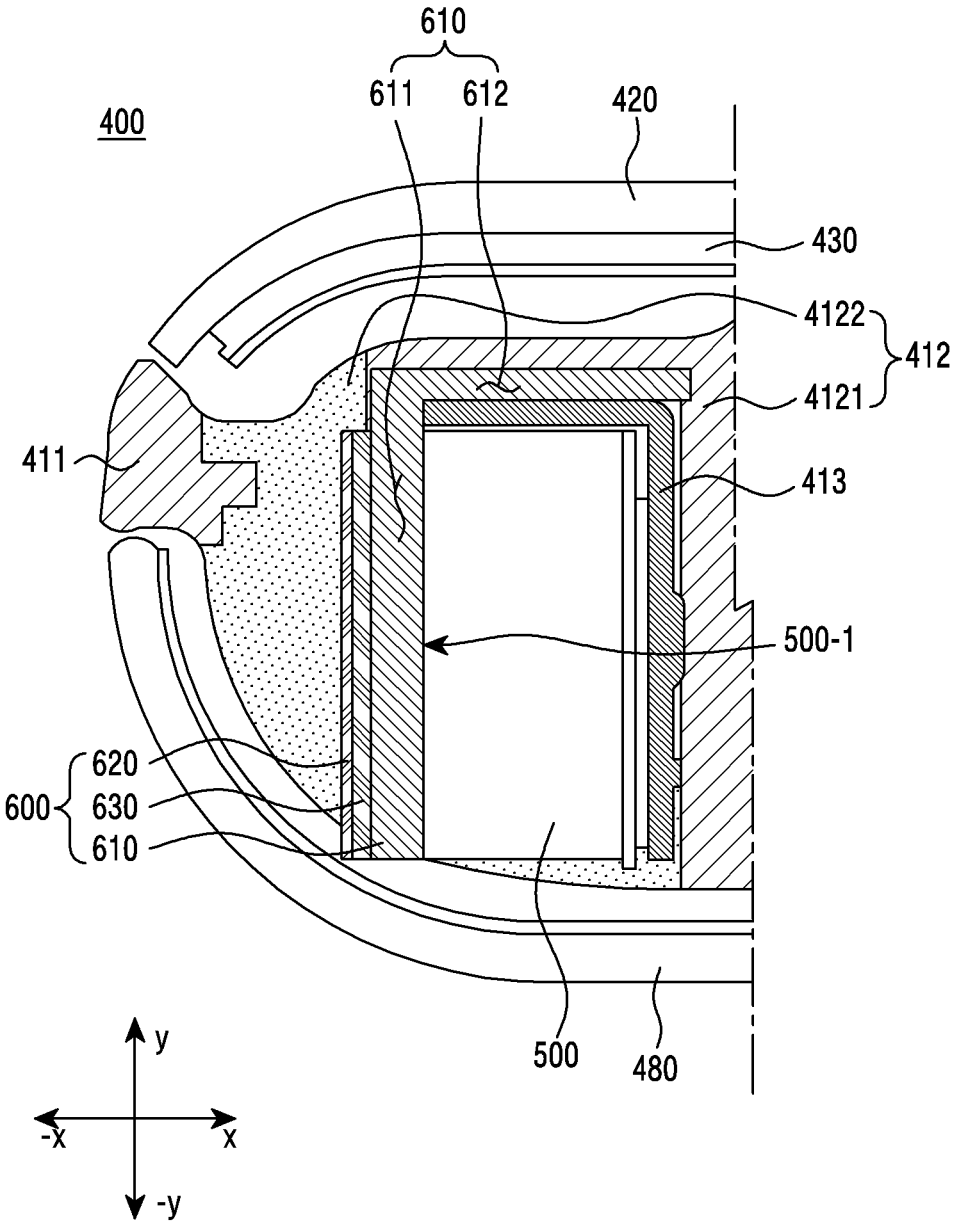
FIG. 10A is a view showing a first dielectric sheet operating as a heat spreader according to an embodiment of the disclosure.

FIG. 10A is a view showing a first dielectric sheet operating as a heat spreader according to an embodiment of the disclosure.

Figure 10B:
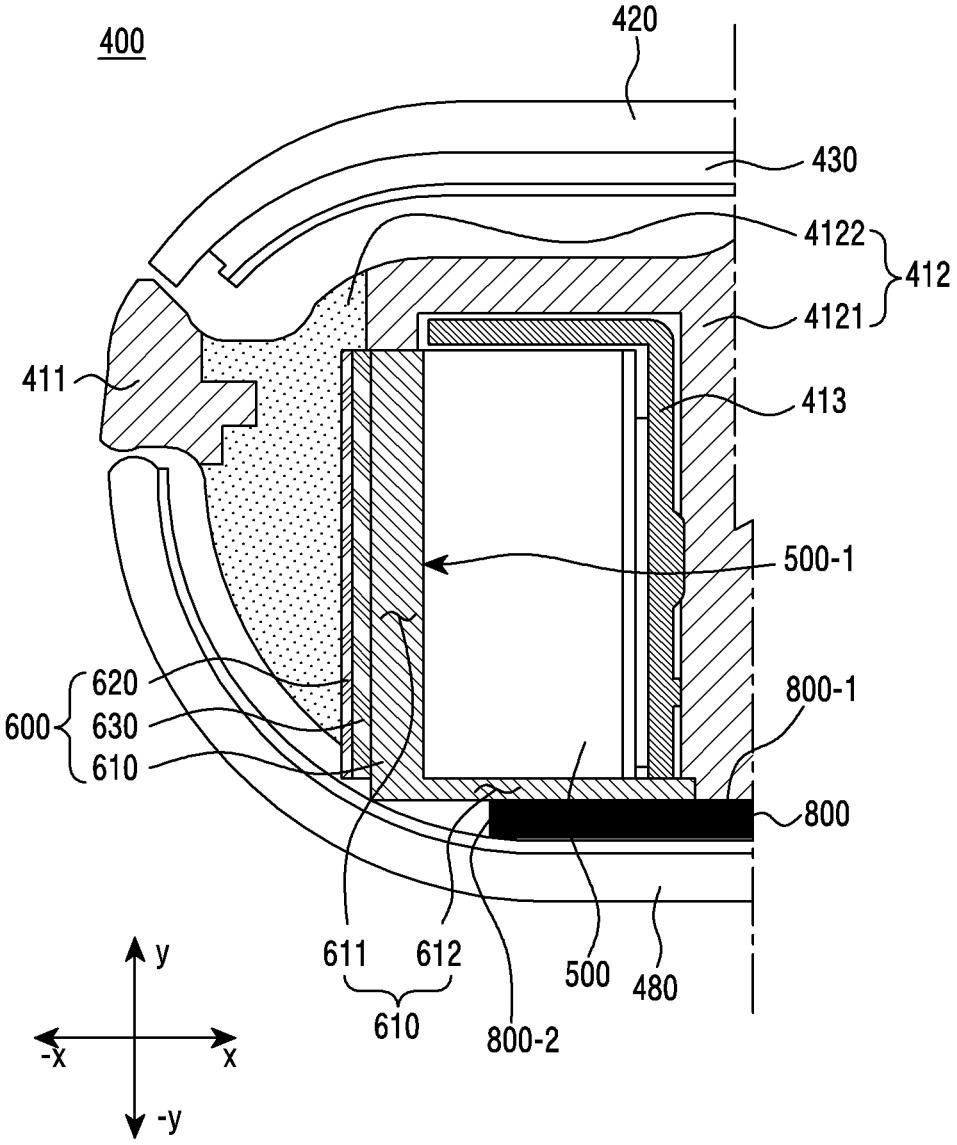
FIG. 10B is a view showing a first dielectric sheet operating as a heat spreader according to an embodiment of the disclosure.

FIG. 10B is a view showing a first dielectric sheet operating as a heat spreader according to an embodiment of the disclosure.

Figure 10C:
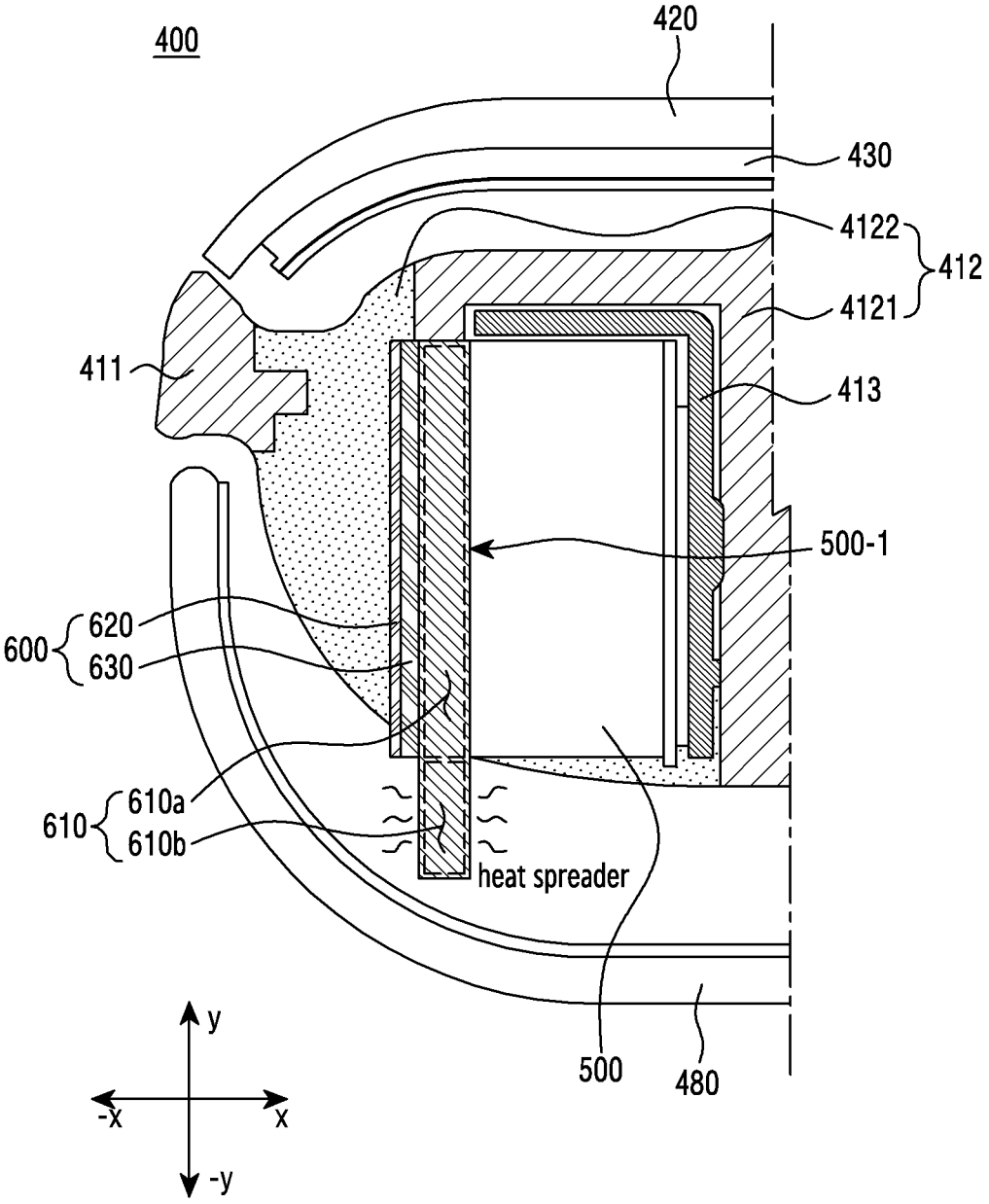
FIG. 10C is a view showing a first dielectric sheet operating as a heat spreader according to an embodiment of the disclosure.

FIG. 10C is a view showing a first dielectric sheet operating as a heat spreader according to an embodiment of the disclosure.

Referring to FIGS. 10A, 10B, and 10C show a cross-section taken along line B-B' of the electronic device shown in FIG. 5 according to various embodiment. Various structure of a first dielectric sheet 610 that operates as a heat spreader are described hereafter with reference to FIGS. 10A, 10B, and/or 10C.

Referring to FIGS. 10A, 10B, and/or 10C, an electronic device 400 according to an embodiment (e.g., the electronic device 400 shown in FIGS. 4 and 5) may include a bracket 410 (e.g., the bracket 410 shown in FIGS. 4 and 5), a front plate 420 (e.g., the front plate 420 shown in FIG. 4), a display 430 (e.g., the display 430 shown in FIG. 4), a rear plate 480 (e.g., the rear plate 480 shown in FIG. 4), at least one antenna module 500 (e.g., at least one antenna module 500 shown in FIGS. 5 and/or 6A, 6B, and 6C), and at least one dielectric sheet 600 (e.g., the at least one dielectric sheet 600 shown in FIGS. 8A and 8B). At least one of the components of the electronic device 400 according to an embodiment may be the same as or similar to at least one of the components of the electronic device 400 shown in FIGS. 7A and 7B and/or the electronic device 400 shown in FIGS. 8A and 8B, and repeated description is omitted below.

According to an embodiment, the at least one dielectric sheet 600 may include a first dielectric sheet 610 (e.g., the first dielectric sheet 610 shown in FIGS. 8A and 8B), a second dielectric sheet 620 (e.g., the second dielectric sheet 620 shown in FIGS. 8A and 8B), and a third dielectric sheet 630 (e.g., the third dielectric sheet 630 shown in FIGS. 8A and 8B). The at least one dielectric sheet 600, as described above, may be attached to a radiation surface (e.g., first surface 500-1), on which an antenna array (e.g., the antenna array 530 shown in FIG. 6A) is disposed, of an at least one antenna module 500 or may be attached to a non-metallic region 4122 (e.g., the non-metallic region 4122 shown in FIG. 4) of a support structure 412 (e.g., the support structure 412 shown in FIG. 4). Though not shown in the figures, in accordance with an embodiment, some components (e.g., the third dielectric sheet 630) of at least one dielectric sheet 600 may be omitted.

According to an embodiment, the first dielectric sheet 610 may be attached to the radiation surface (e.g., first surface 500-1) of the at least one antenna module 500 or may be disposed on the radiation surface (e.g., first surface 500-1) (e.g., in −x-direction in FIG. 10A). The first dielectric sheet 610 is made of a thermal conductivity material, thereby being able to operate as a heat spreader that dissipates heat generated by the antenna module 500.

Referring to FIG. 10A, the first dielectric sheet 610 according to an embodiment may include a first portion 611 and a second portion 612 substantially perpendicular to the first portion 611. The first portion 610*a* of the first dielectric sheet 610 may be attached to at least a partial region of the radiation surface (e.g., first surface 500-1) of the at least one antenna module 500. The second portion 610*b* of the first dielectric sheet 610 may extend substantially perpendicularly to the first portion 611 (e.g., x-direction in FIG. 10A) from an end of the first portion 611 (e.g., an end in y-direction in FIG. 10A) and may be in contact with a partial region of the support structure 412. In an embodiment, the second portion 612 of the first dielectric sheet 610 may be in contact with at least a partial region of the metallic region 4121 of the support structure 412. In another embodiment, the second portion 612 of the first dielectric sheet 610 may be in contact with at least a partial region of the metal plate 413 (e.g., a copper plate) for fixing the at least one antenna module 500 to the support structure 412. Since the first portion 611 having thermal conductivity of the first dielectric sheet 610 is in contact with the radiation surface (e.g., first surface 500-1) of the antenna module 500 and the second portion 612 is in contact with the metallic region 4121 and/or the metal plate 413, heat that is generated by the antenna module 500 when an RF signal is transmitted and/or received can spread to the metallic region 4121 and/or the metal plate 413. That is, in the electronic device 400 according to an embodiment, the heat generated by the antenna module 500 spreads to the metallic region 4121 and/or the metal plate 413 through the first portion 611 and the second portion 612 of the first dielectric sheet 610, whereby the heat generated by the antenna module 500 can be dissipated.

Referring to FIG. 10B, a first dielectric sheet 610 according to another embodiment may include a first portion 611 and a second portion 612 substantially perpendicular to the first portion 611. An electronic device 400 according another embodiment may further include a graphite sheet 800 disposed between the support structure 412 of the bracket 410 and the rear plate 480. The graphite sheet 800 has high thermal conductivity, so it can dissipate heat that is generated by electronic parts mounted in the electronic device 400. In this configuration, a partial region of the first dielectric sheet 610 is in contact with the graphite sheet 800, so the graphite sheet 800 can dissipate even the heat generated by the at least one antenna module 500. In an embodiment, the first region 610*a* of the first dielectric sheet 610 may be attached to at least a partial region of the radiation surface (e.g., first surface 500-1) of the at least one antenna module 500. The second portion 612 of the first dielectric sheet 610 may extend substantially perpendicularly to the first region 610*a* (e.g., x-direction in FIG. 10B) from an end of the first portion 611 (e.g., an end in −y-direction in FIG. 10B) and may be in contact with a partial region of the graphite sheet 800. In an embodiment, the second portion 612 of the first dielectric sheet 610 may be in contact with at least a partial region of one surface 800-1 facing the bracket 410 of the graphite sheet 800. In another embodiment (not shown), the second portion 612 may be in contact with at least a partial region of one surface 800-2, which faces the metal frame structure 411, of the graphite sheet 800. Since the first portion 611 having thermal conductivity of the first dielectric sheet 610 is in contact with the radiation surface (e.g., first surface 500-1) of the antenna module 500 and the second portion 612 is in contact with the graphite sheet 800, heat that is generated by the antenna module 500 when an RF signal is transmitted and/or received can spread to the graphite sheet 800. That is, in the electronic device 400 according to another embodiment, the heat generated by the antenna module 500 spreads to the graphite sheet 800 through the first dielectric sheet 610, whereby the heat generated by the antenna module 500 can be dissipated.

As described above, in the electronic device 400 according to an embodiment, since the heat generated by the at least one antenna module 500 spreads to the metallic region 4121, the metal plate 413, and the graphite sheet 800 that have high thermal conductivity, heat dissipation efficiency can be improved.

Referring to FIG. 10C, a first dielectric sheet 610 according to another embodiment may have a first region 610*a* and a second region 610*b*. In an embodiment, the first region 610*a* of the first dielectric sheet 610 may be attached to at least a partial region of a radiation surface (e.g., first surface 500-1) of an at least one antenna module 500. The second region 610*b* of the first dielectric sheet 610 may protrude toward the rear plate 480 (e.g., in −y-direction in FIG. 10C) from the first region 610*a*, and accordingly, the second region 610*b* may not overlap the radiation surface (e.g., first surface 500-1) of the antenna module 500. That is, since the second region 610*b* extends from the first region 610*a*, the heat generated by the antenna module 500 can spread to the second region 610*b* through the first region 610*a*. Further, the heat spreading to the second region 610*b* can be dissipated to the surrounding of the second region 610*b*. That is, the second region 610*b* of the first dielectric sheet 610 can operate as a heat spreader that dissipate the heat generated by the antenna module 500 to the surrounding of the first dielectric sheet 610.

Figure 11A:
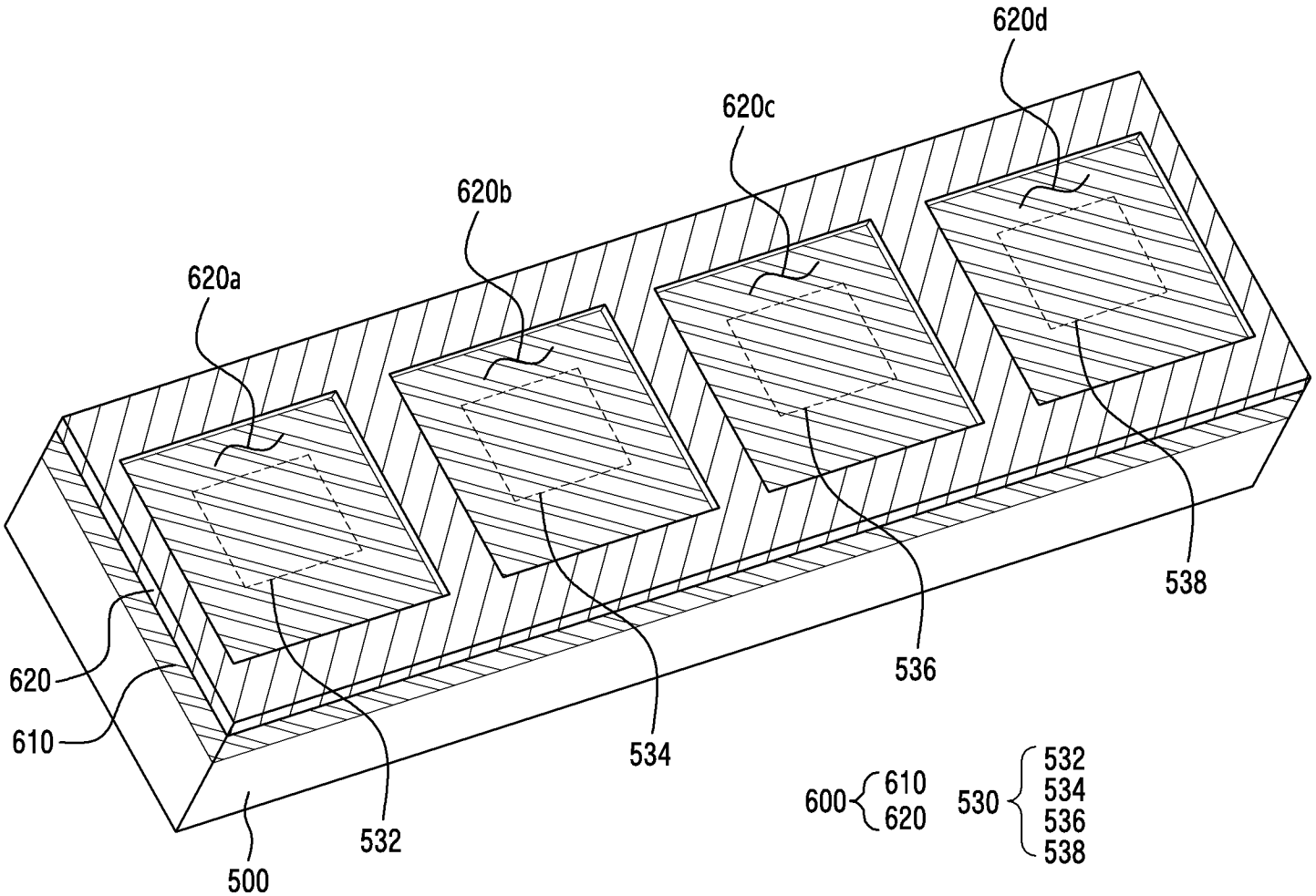
FIG. 11A is a perspective view showing an antenna module and a dielectric sheet attached to the antenna module seen from a side according to an embodiment of the disclosure.

FIG. 11A is a perspective view showing an antenna module and a dielectric sheet attached to the antenna module seen from a side according to an embodiment of the disclosure.

Figure 11B:
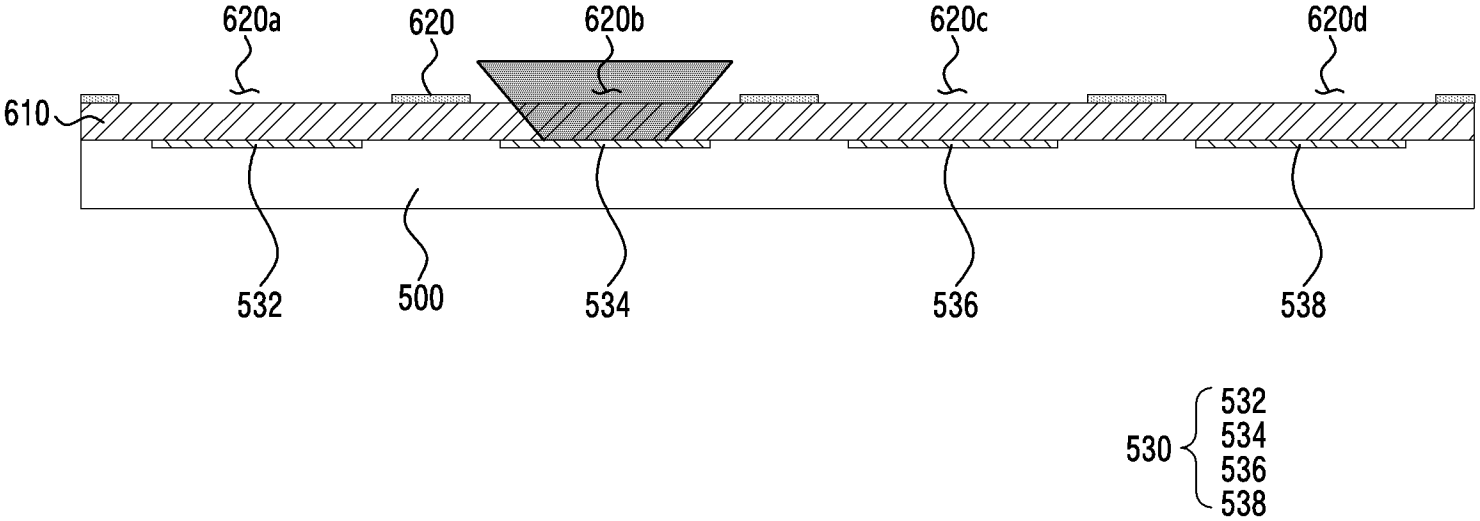
FIG. 11B is a side view showing an antenna module and a dielectric sheet attached to the antenna module shown in FIG. 11A seen from a side according to an embodiment of the disclosure.

FIG. 11B is a side view showing the antenna module and the dielectric sheet attached to the antenna module shown in FIG. 11A seen from a side according to an embodiment of the disclosure. FIGS. 11A and 11B of the disclosure show only an antenna module 500 fixed to a partial region of a bracket (e.g., the bracket 410 shown in FIG. 7B) and at least one dielectric sheet 600 attached to the antenna module 500.

Referring to FIGS. 11A and 11B, at least one dielectric sheet 600 (e.g., the at least one dielectric sheet 600 shown in FIGS. 7A and 7B) may be attached to a radiation surface (e.g., the radiation surface 500-1 shown in FIG. 7B), on which an antenna array 530 (e.g., the antenna array 530 shown in FIG. 6A) is disposed, of an antenna module 500 (e.g., the antenna module 500 shown in FIGS. 6A, 7A and/or 7B).

The antenna array 530 according to an embodiment may include a plurality of antenna elements 532, 534, 536, and 538 and the plurality of antenna elements 532, 534, 536, and 538 may be arranged with predetermined intervals on the radiation surface of the antenna module 500.

The at least one dielectric sheet according to an embodiment may include a first dielectric sheet 610 (e.g., the first dielectric sheet 610 shown in FIGS. 7A and 7B) and a second dielectric sheet 620 (e.g., the second dielectric sheet 620 shown in FIGS. 7A and 7B).

In an embodiment, the first dielectric sheet 600 (e.g., a low-permittivity heat dissipation sheet) may be made of a thermal conductive material having a low permittivity and may be attached to the radiation surface, on which the antenna array 530 is disposed, of the antenna module 500. As described above, the first dielectric sheet 610 is attached to the radiation surface of the antenna module 500, thereby being able to operate as a heat spreader that dissipate heat generated by the antenna module 500.

In an embodiment, the second dielectric sheet 620 may be disposed on the first dielectric sheet 610 and made of a material having a higher permittivity than the first dielectric sheet 610, thereby being able to decrease the wavelength of an antenna beam that is radiated from the antenna module 500.

As described above, the higher the permittivity of a dielectric sheet that transmits an antenna beam, the smaller the wavelength of the antenna beam and the loss of transmission (e.g., loss tangent) of the antenna beam may be. In the electronic device 400 according to an embodiment, at least one first opening 620*a*, 620*b*, 620*c*, and 620*d* is formed by removing a partial region of the second dielectric sheet 620 having a higher permittivity than the first dielectric sheet 610, whereby it is possible to reduce the loss of transmission of an antenna beam. In an embodiment, the at least one first opening 620*a*, 620*b*, 620*c*, and 620*d* may be formed in at least a partial region, which corresponds to antenna elements 532, 534, 536, and 538, of the second dielectric sheet 620. For example, a 1-1 opening 620*a* may be formed in at least a partial region, which corresponds to the first antenna element 532, of the second dielectric sheet 620, and a 1-2 opening 620*b* may be formed in at least a partial region, which corresponds to the second antenna element 534, of the second dielectric sheet 620. Similarly, a 1-3 opening 620*c* may be formed in at least a partial region, which corresponds to the third antenna element 536, of the second dielectric sheet 620, and a 1-4 opening 620*d* may be formed in at least a partial region, which corresponds to the fourth antenna element 538, of the second dielectric sheet 620. Since the at least one opening 620*a*, 620*b*, 620*c*, and 620*d* is formed in the second dielectric sheet 620, a multi-operation structure may be formed between the first dielectric sheet 610 and the second dielectric sheet 620. The multi-operation structure formed between the first dielectric sheet 610 and the second dielectric sheet 620 can guide the radiation direction of an antenna beam such that the antenna beam radiated from the antenna array 530 travels in a boresight direction.

In an embodiment, the at least one first opening 620*a*, 620*b*, 620*c*, and 620*d* may be formed such that the outer surface thereof includes the outer surface of the antenna elements 532, 534, 536, and 538. However, the disclosure is not limited thereto and, in another embodiment, the outer surface of the at least one first opening 620*a*, 620*b*, 620*c*, and 620*d* may include only partial regions of the antenna elements 532, 534, 536, and 538, which will be described in detail below.

According to an embodiment, the at least one first opening 620*a*, 620*b*, 620*c*, and 620*d* may be formed in a rectangular shape. However, the disclosure is not limited thereto and the at least one first opening 620*a*, 620*b*, 620*c*, and 620*d* may be formed in various shapes such as an ellipse, a diamond, and a cross.

Figure 12A:
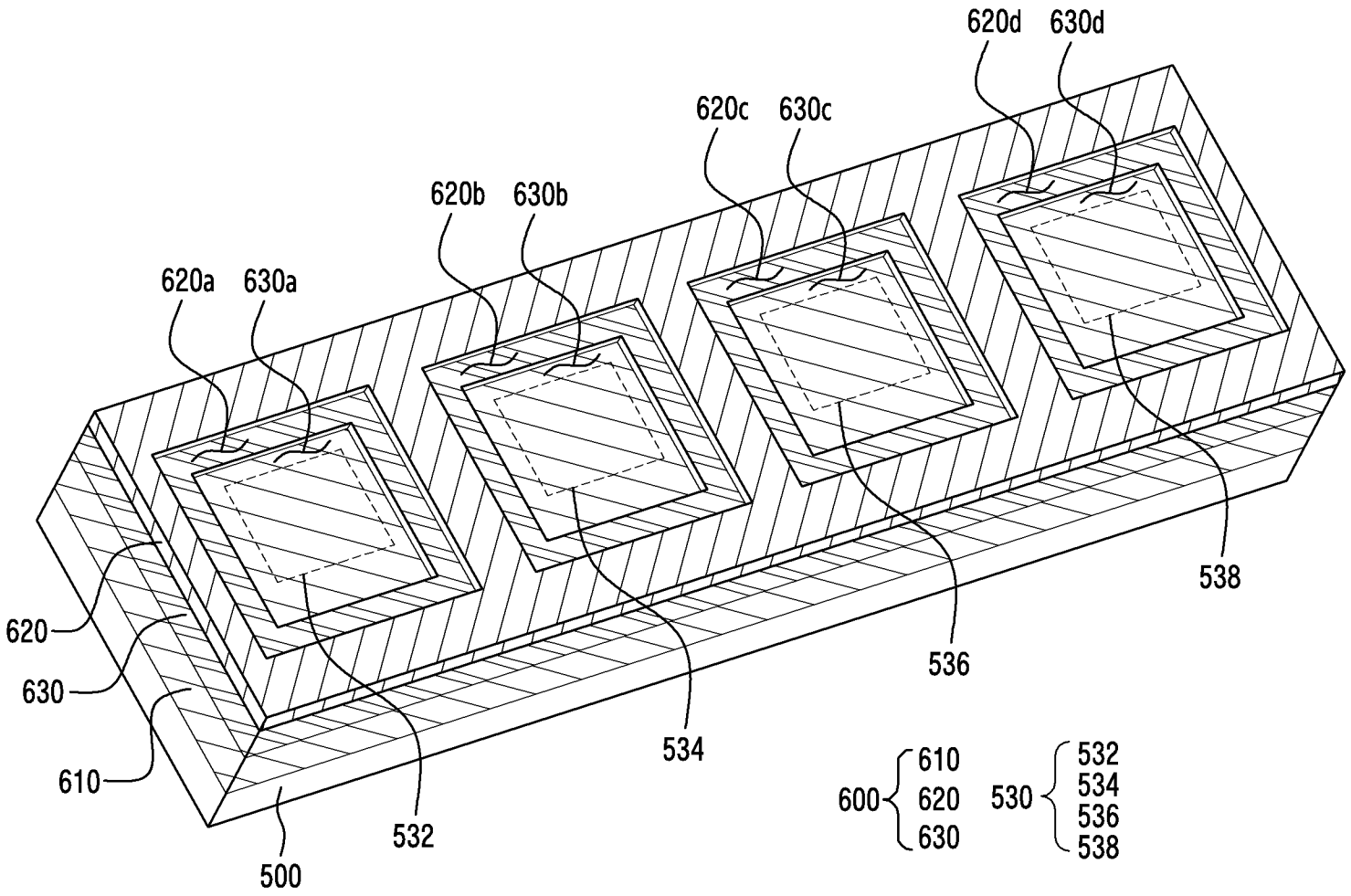
FIG. 12A is a perspective view showing an antenna module and a dielectric sheet attached to the antenna module seen from a side according to an embodiment of the disclosure.

FIG. 12A is a perspective view showing an antenna module and a dielectric sheet attached to the antenna module seen from a side according to an embodiment of the disclosure.

Figure 12B:
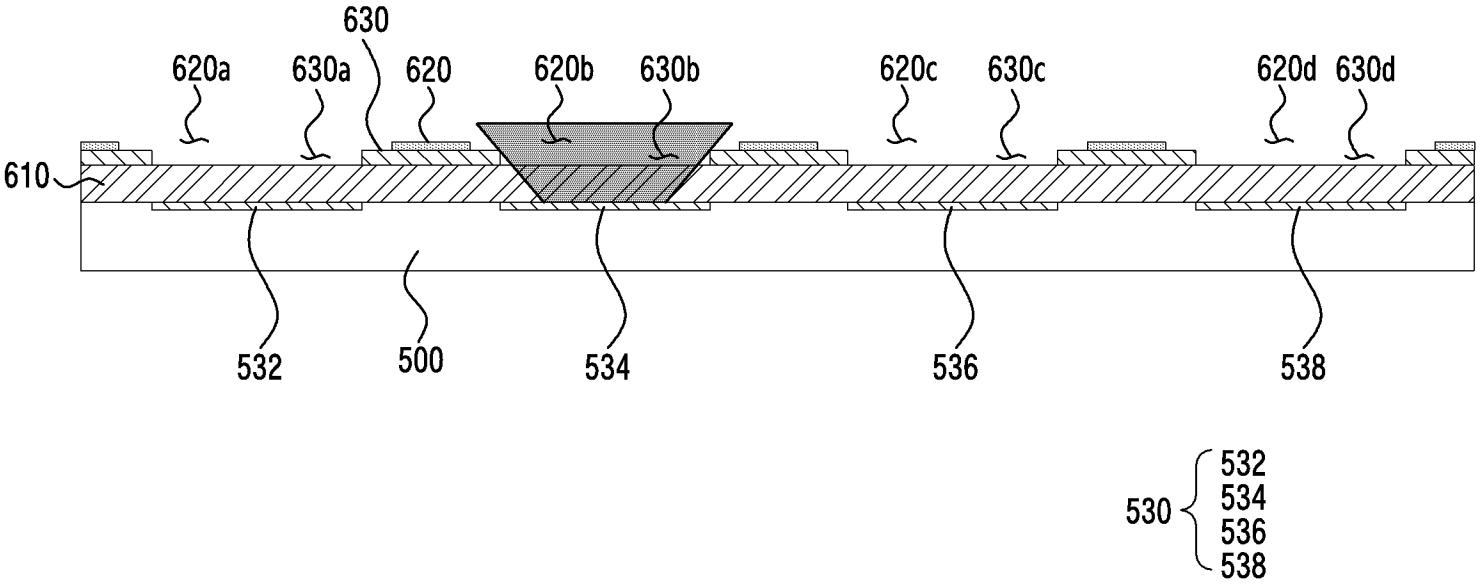
FIG. 12B is a side view showing an antenna module and a dielectric sheet attached to the antenna module shown in FIG. 12A seen from a side according to an embodiment of the disclosure.

FIG. 12B is a side view showing the antenna module and the dielectric sheet attached to the antenna module shown in FIG. 12A seen from a side according to an embodiment of the disclosure.

Figure 12C:
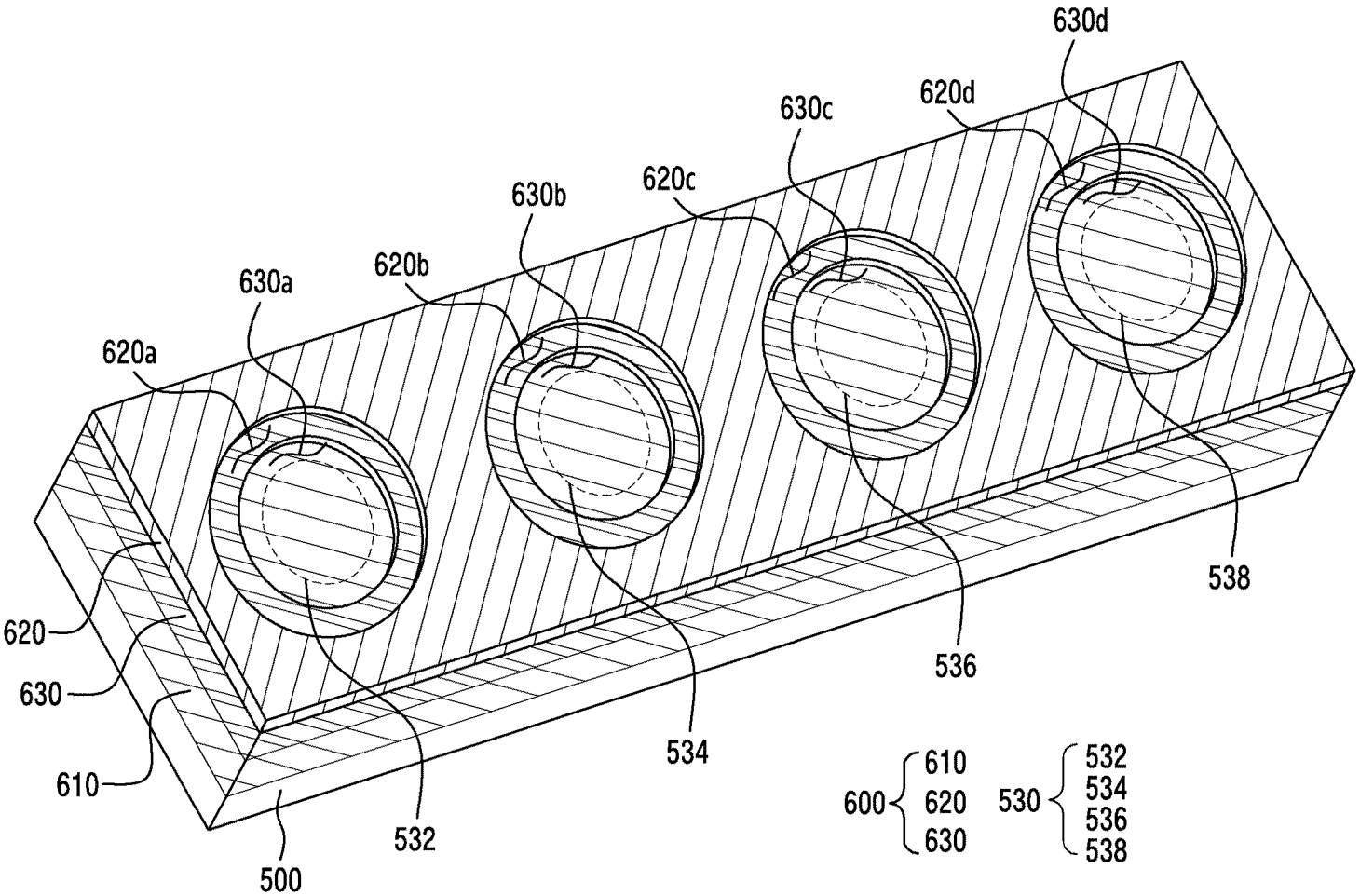
FIG. 12C is a perspective view showing an antenna module and a dielectric sheet attached to the antenna module seen from a side according to an embodiment of the disclosure.

FIG. 12C is a perspective view showing an antenna module and a dielectric sheet attached to the antenna module seen from a side according to an embodiment of the disclosure.

Figure 12D:
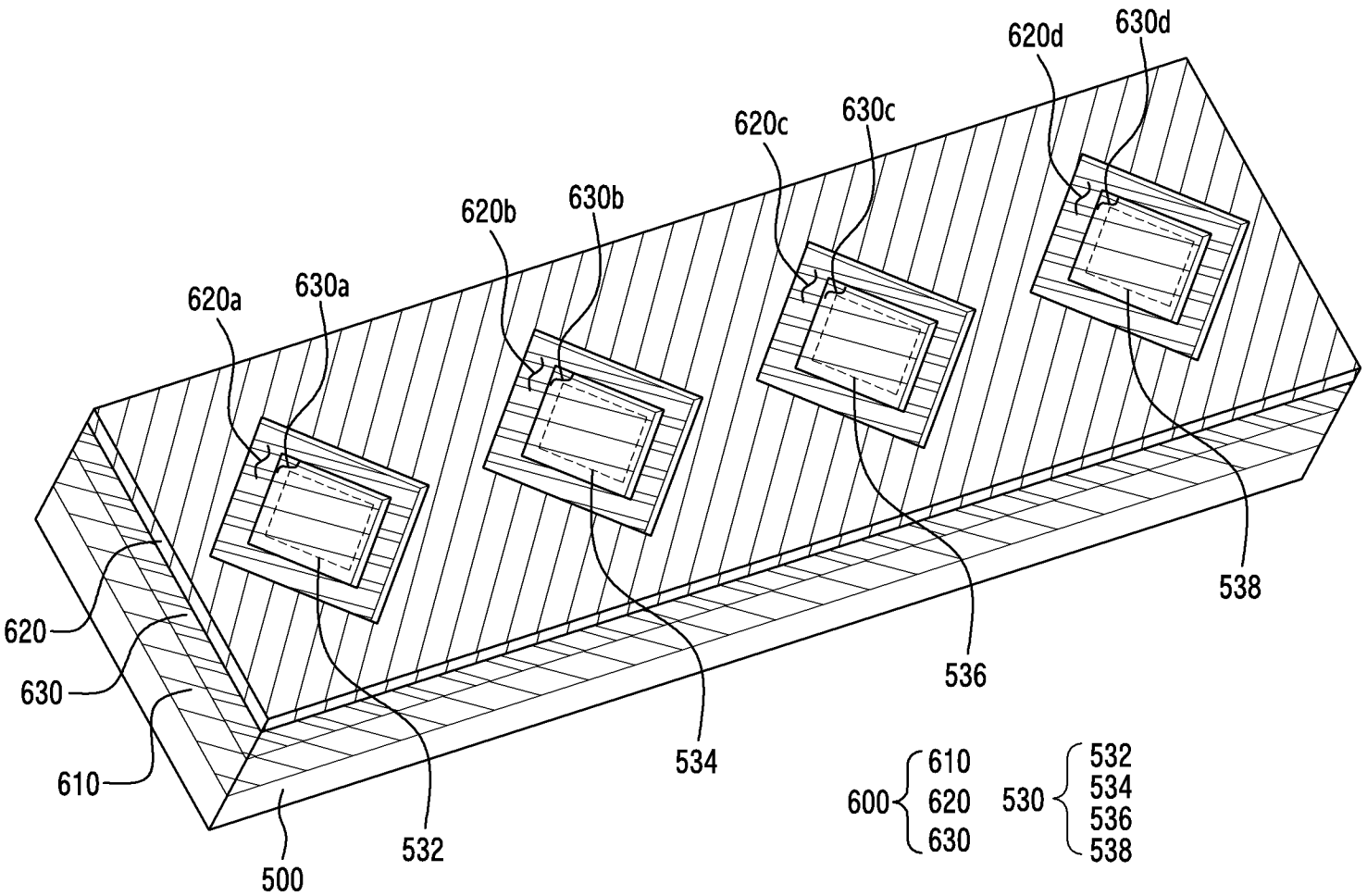
FIG. 12D is a perspective view showing an antenna module and a dielectric sheet attached to the antenna module seen from a side according to an embodiment of the disclosure.

FIG. 12D is a perspective view showing an antenna module and a dielectric sheet attached to the antenna module seen from a side according to an embodiment of the disclosure.

Figure 12E:
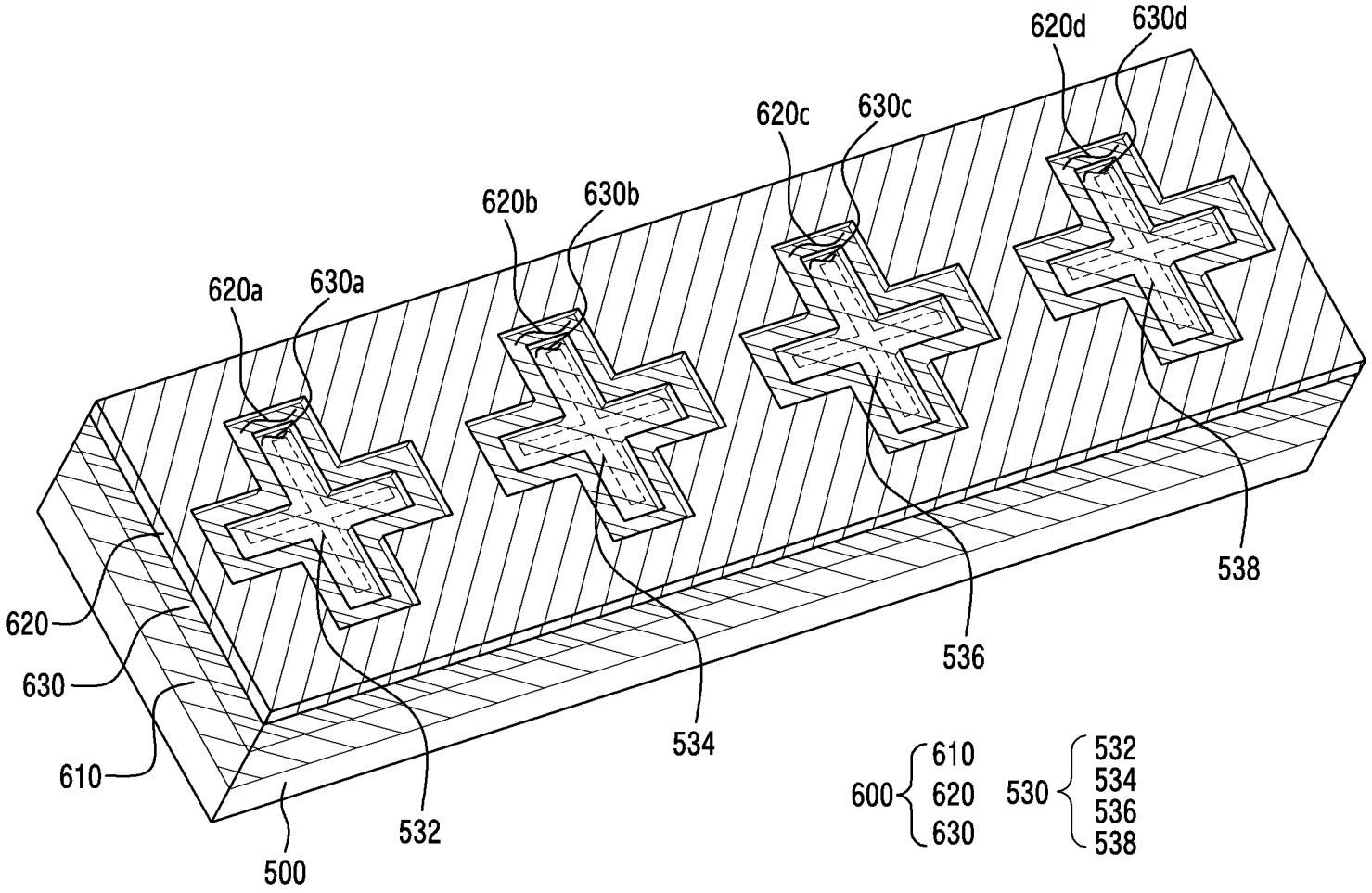
FIG. 12E is a perspective view showing an antenna module and a dielectric sheet attached to the antenna module seen from a side according to an embodiment of the disclosure.

FIG. 12E is a perspective view showing an antenna module and a dielectric sheet attached to the antenna module seen from a side according to an embodiment of the disclosure. FIG. 12A to FIG. 12D of the disclosure show only an antenna module 500 fixed to a partial region of a bracket (e.g., the bracket 410 shown in FIG. 8B) and at least one dielectric sheet 600 attached to the antenna module 500.

Referring to FIGS. 12A, 12B, 12C, 12D, and 12E, at least one dielectric sheet 600 (e.g., the at least one dielectric sheet 600 shown in FIGS. 8A and/or 8B) may be attached to a radiation surface (e.g., the first surface 500-1 shown in FIG. 8B), on which an antenna array 530 (e.g., the antenna array 530 shown in FIG. 6A) is disposed, of an antenna module 500 (e.g., the antenna module shown in FIGS. 6A, 8A, and/or 8B).

The antenna array 530 according to an embodiment may include a plurality of antenna elements 532, 534, 536, and 538 and the plurality of antenna elements 532, 534, 536, and 538 may be arranged with predetermined intervals on the radiation surface of the antenna module 500.

The at least one dielectric sheet 600 according to an embodiment may include a first dielectric sheet 610 (e.g., the first dielectric sheet 610 shown in FIGS. 8A and 8B), a second dielectric sheet 620 (e.g., the second dielectric sheet 620 shown in FIGS. 8A and 8B), and a third dielectric sheet 630 (e.g., the third dielectric sheet 630 shown in FIGS. 8A and 8B). That is, the at least one dielectric sheet 600 according to an embodiment may be a dielectric sheet further include the third dielectric sheet 630 in the at least one dielectric sheet 600 shown in FIGS. 11A and 11B.

In an embodiment, the first dielectric sheet 610 may be made of a thermal conductive material having a low permittivity and may be attached to the radiation surface, on which the antenna array 530 is disposed, of the antenna module 500. As described above, the first dielectric sheet 610 is attached to the radiation surface of the antenna module 500, thereby being able to operate as a heat spreader that dissipate heat generated by the antenna module 500.

In an embodiment, the second dielectric sheet 620 may be disposed on the first dielectric sheet 610 and made of a material having a higher permittivity than the first dielectric sheet 610, thereby being able to decrease the wavelength of an antenna beam that is radiated from the antenna module 500.

In an embodiment, the third dielectric sheet 630 may be disposed between the first dielectric sheet 610 and the second dielectric sheet 620 and may be made of a material having a permittivity higher than that of the first dielectric sheet 610 and lower than that of the second dielectric sheet 620. The third dielectric sheet 630 is made of a material having a permittivity between those of the first dielectric sheet 610 and the second dielectric sheet 620, thereby being able to attenuate a rapid change of a permittivity.

Since the higher the permittivity of a dielectric sheet transmitting an antenna beam, the larger the loss of transmission (e.g., loss tangent) of the antenna beam may be, at least one opening is formed in the second dielectric sheet 620 and the third dielectric sheet 630 in the electronic device 400 according to an embodiment, thereby being able to reduce a loss of transmission that is generated when an antenna beam passes through the at least one dielectric sheet 600.

In an embodiment, the at least one first opening 620*a*, 620*b*, 620*c*, and 620*d* may be formed in at least a partial region of the second dielectric sheet 620 that corresponds to antenna elements 532, 534, 536, and 538. Similarly, the at least one second opening 630*a*, 630*b*, 630*c*, and 630*d* may be formed in at least a partial region of the third dielectric sheet 630 that corresponds to antenna elements 532, 534, 536, and 538. For example, a 1-1 opening 620*a* and a 2-1 opening 630*a* may be respectively formed in at least partial regions of the second dielectric sheet 620 and the third dielectric sheet 630 corresponding to the first antenna element 532, and a 1-2 opening 620*b* and a 2-2 opening 630*b* may be respectively formed in at least partial regions of the second dielectric sheet 620 and the third dielectric sheet 630 corresponding to the second antenna element 534. Similarly, a 1-3 opening 620*c* and a 2-3 opening 630*c* may be respectively formed in at least partial regions of the second dielectric sheet 620 and the third dielectric sheet 630 corresponding to the third antenna element 536, and a 1-4 opening 620*d* and a 2-4 opening 630*d* may be respectively formed in at least partial regions of the second dielectric sheet 620 and the third dielectric sheet 630 corresponding to the fourth antenna element 538.

Since the at least one first opening 620*a*, 620*b*, 620*c*, and 620*d* is formed in the second dielectric sheet 620 and at least one second opening 630*a*, 630*b*, 630*c*, and 630*d* is formed in the third dielectric sheet 630, a multi-operation structure may be formed between the first dielectric sheet 610, the second dielectric sheet 620, and the third dielectric sheet 630. For example, a multi-operation structure may be formed between the first dielectric sheet 610 and the third dielectric sheet 630 by the at least one second opening 630*a*, 630*b*, 630*c*, and 630*d*. Further, a multi-operation structure may also be formed between the third dielectric sheet 630 and the second dielectric sheet 620 by the at least one first opening 620*a*, 620*b*, 620*c*, and 620*d*. The multi-operation structure formed between the first dielectric sheet 610, the second dielectric sheet 620, and the third dielectric sheet 630 can guide the radiation direction of an antenna beam such that the antenna beam radiated from the antenna array 530 travels in a boresight direction.

In an embodiment (e.g., see FIG. 12A), the at least one first opening 620*a*, 620*b*, 620*c*, and 620*d* and the at least one second opening 630*a*, 630*b*, 630*c*, and 630*d* may be formed such that the outer surfaces thereof each include the outer surface of the antenna elements 532, 534, 536, and 538. In another embodiment (e.g., see FIGS. 12C, 12D, and 12E), the at least one first opening 620*a*, 620*b*, 620*c*, and 620*d* and the at least one second opening 630*a*, 630*b*, 630*c*, and 630*d* may be formed such that the outer surfaces thereof each include only a partial region of the outer surface of the antenna elements 532, 534, 536, and 538.

The second dielectric sheet 620 is made of a material having a higher permittivity than the third dielectric sheet 630, so a larger loss of transmission may be generated when the antenna beam radiated from the antenna module 500 passes through the second dielectric sheet 620 than when the antenna beam passes through the third dielectric sheet 630. Accordingly, the at least one first opening 620*a*, 620*b*, 620*c*, and 620*d* may be formed to have a larger size than the at least one second opening 630*a*, 630*b*, 630*c*, and 630*d*. In an embodiment, the at least one first opening 620*a*, 620*b*, 620*c*, and 620*d* may be formed such that the outer surface thereof includes the outer surface of the at least one second opening

630*a*, 630*b*, 630*c*, and 630*d*. According to an embodiment, the at least one first opening 620*a*, 620*b*, 620*c*, and 620*d* and the at least one second opening 630*a*, 630*b*, 630*c*, and 630*d* may be formed have the same shape except for the sizes of the outer surfaces. However, the disclosure is not limited thereto and, according to another embodiment (not shown), the at least one first opening 620*a*, 620*b*, 620*c*, and 620*d* and the at least one second opening 630*a*, 630*b*, 630*c*, and 630*d* may be formed in different shapes. For example, the at least one first opening 620*a*, 620*b*, 620*c*, and 620*d* may be formed in a rectangular shape and the at least one second opening 630*a*, 630*b*, 630*c*, and 630*d* may be formed in an elliptical shape.

Referring to FIG. 12A, according to an embodiment, the at least one first opening 620*a*, 620*b*, 620*c*, and 620*d* and/or the at least one second opening 630*a*, 630*b*, 630*c*, and 630*d* may be formed in a rectangular shape. However, the disclosure is not limited thereto, and according to an embodiment, the at least one first opening 620*a*, 620*b*, 620*c*, and 620*d* and/or the at least one second opening 630*a*, 630*b*, 630*c*, and 630*d* may be formed in various shapes other than a rectangular shape. For example, the at least one first opening 620*a*, 620*b*, 620*c*, and 620*d* and/or the at least one second opening 630*a*, 630*b*, 630*c*, and 630*d*, depending on embodiments, may be formed in an elliptical shape (e.g., see FIG. 12C), or in a diamond shape (e.g., see FIG. 12D), or in a cross shape (e.g., see FIG. 12E).

That is, in the electronic device 400 according to an embodiment, the first dielectric sheet 610 is attached to the radiation surface of the antenna module 500 and can dissipate the heat generated by the antenna module 500. Further, openings (e.g., the first opening and the second opening) are formed in a partial region of the second dielectric sheet 620 and/or the third dielectric sheet 630, whereby it is possible to secure a beam coverage in the boresight direction.

An electronic device according to an embodiment includes a display having a first surface facing a first direction; a metal frame structure configured to form a side surface, which faces a second direction perpendicular to the first direction, of the electronic device; a rear plate having a second surface facing a third direction opposite to the first direction; at least one antenna module disposed inside the side surface and having a radiation surface facing the second direction; at least one dielectric layer having at least a partial region attached to the radiation surface of the antenna array, and disposed between the at least one antenna module and the side surface; and a wireless communication circuit configured to transmit or receive an RF signal in a predetermined frequency band to or from the at least one antenna module, in which the at least one dielectric layer includes a first dielectric sheet attached to at least a partial region of the radiation surface of the antenna module and a second dielectric sheet disposed on the first dielectric sheet in the second direction; and the first dielectric sheet is made of a thermal conductive material having a first permittivity and the second dielectric sheet is made of a material having a second permittivity larger than the first permittivity.

According to an embodiment, the electronic device may further include a third dielectric sheet disposed between the first dielectric sheet and the second dielectric sheet and having a third permittivity.

According to an embodiment, the third permittivity may be larger than the first permittivity and smaller than the second permittivity.

According to an embodiment, the thickness of the second dielectric sheet may be smaller than the thickness of the first dielectric sheet.

According to an embodiment, the at least one dielectric layer may be spaced apart from the metal frame structure.

According to an embodiment, the first dielectric sheet may have a first portion attached to at least a partial region of the radiation surface of the antenna module and a second portion substantially perpendicular to the first portion and being in contact with a metallic region in the electronic device.

According to an embodiment, heat that is generated by the at least one antenna module may spread to the metallic region in the electronic device through the second portion of the first dielectric sheet.

According to an embodiment, the electronic device may further include a graphite sheet disposed between the metal frame structure and the rear plate.

According to an embodiment, the first dielectric sheet may further have a first portion attached to at least a partial region of the radiation surface of the antenna module and a second portion substantially perpendicular to the first portion and being in contact with a partial region of the graphite sheet.

According to an embodiment, heat that is generated by the at least one antenna module may spread to the graphite sheet through the second portion of the first dielectric sheet.

According to an embodiment, the first dielectric sheet may have a first region attached to the radiation surface of the at least one antenna module and a second region protruding from the first region in the first direction or the third direction, and the second region may operate as a heat spreader configured to dissipate heat that is generated by the at least one antenna module to the surrounding of the second region.

According to an embodiment, the at least one antenna module may include a printed circuit board and an antenna array disposed on the printed circuit board and including a plurality of antenna elements configured to transmit or receive an RF signal in a predetermined frequency band.

According to an embodiment, the second dielectric sheet may have at least one first opening formed at a position corresponding to at least a partial region of the plurality of antenna elements.

According to an embodiment, the electronic device may further include a third dielectric sheet disposed between the first dielectric sheet and the second dielectric sheet and having a third permittivity, in which the third dielectric sheet may have at least one second opening formed at a position corresponding to at least a partial region of the plurality of antenna elements.

According to an embodiment, an outer surface of the first opening may be formed in a shape including an outer surface of the plurality of antenna elements.

According to an embodiment, an outer surface of the second opening may be formed in a shape including an outer surface of the first opening.

An electronic device according to an embodiment includes a display having a first surface facing a first direction; a metal frame structure configured to form a side surface, which faces a second direction perpendicular to the first direction, of the electronic device; a rear plate having a second surface facing a third direction opposite to the first direction; at least one antenna module disposed inside the side surface and having a radiation surface facing the second direction; at least one dielectric layer having at least a partial region attached to an inner side of the side surface, and disposed between the at least one antenna module and the side surface; and a wireless communication circuit configured to transmit or receive an RF signal in a predetermined frequency band to or from the at least one antenna module, in which the at least one dielectric layer includes a first dielectric sheet disposed on the radiation surface of the at least one antenna module in the second direction and a second dielectric sheet disposed between the first dielectric sheet and the side surface and having a surface attached to the inner side of the side surface, in which the first dielectric sheet is made of a thermal conductive material having a first permittivity and the second dielectric sheet is made of a material having a second permittivity larger than the first permittivity.

According to an embodiment, the electronic device may further include a third dielectric sheet disposed between the first dielectric sheet and the second dielectric sheet and having a third permittivity.

According to an embodiment, the third permittivity may be larger than the first permittivity and smaller than the second permittivity.

An electronic device according to an embodiment includes a display having a first surface facing a first direction; a metal frame structure configured to form a side surface, which faces a second direction perpendicular to the first direction, of the electronic device; a rear plate having a second surface facing a third direction opposite to the first direction; at least one antenna module disposed inside the side surface; at least one dielectric layer disposed between the at least one antenna module and the side surface; and a wireless communication circuit configured to transmit or receive an RF signal in a predetermined frequency band to or from the at least one antenna module, in which the at least one antenna module includes a printed circuit board having a third surface facing the second direction and a fourth surface facing an opposite direction to the second direction, and a plurality of antenna elements disposed on the first surface of the printed circuit board; the at least one dielectric layer includes a first dielectric sheet attached to at least a partial region of the third surface of the printed circuit board and made of a thermal conductive material having a first permittivity and a second dielectric sheet disposed on the first dielectric sheet in the second direction and made of a material having a second permittivity larger than the first permittivity; and the second dielectric sheet may have at least one first opening formed at a position corresponding to at least a partial region of the plurality of antenna elements.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a display having a first surface facing a first direction;

a metal frame structure configured to form a side surface, which faces a second direction perpendicular to the first direction, of the electronic device;

a rear plate having a second surface facing a third direction opposite to the first direction;

at least one antenna module disposed inside the side surface and having a radiation surface facing the second direction;

at least one dielectric layer having at least one partial region attached to the radiation surface of an antenna array, and disposed between the at least one antenna module and the side surface; and a wireless communication circuit configured to transmit or receive a radio frequency (RF) signal in a predetermined frequency band to or from the at least one antenna module, wherein the at least one dielectric layer comprises a first dielectric sheet attached to at least one partial region of the radiation surface of the antenna module and a second dielectric sheet disposed on the first dielectric sheet in the second direction, and wherein the first dielectric sheet comprises a thermal conductive material having a first permittivity and the second dielectric sheet comprising a material having a second permittivity larger than the first permittivity.

2. The electronic device of claim 1, further comprising a third dielectric sheet disposed between the first dielectric sheet and the second dielectric sheet and having a third permittivity.

3. The electronic device of claim 2, wherein the third permittivity is larger than the first permittivity and smaller than the second permittivity.

4. The electronic device of claim 1, wherein a thickness of the second dielectric sheet is smaller than a thickness of the first dielectric sheet.

5. The electronic device of claim 1, wherein the at least one dielectric layer is spaced apart from the metal frame structure.

6. The electronic device of claim 1, wherein the first dielectric sheet has a first portion attached to the at least one partial region of the radiation surface of the antenna module and a second portion substantially perpendicular to the first portion and being in contact with a metallic region in the electronic device.

7. The electronic device of claim 6, wherein heat that is generated by the at least one antenna module spreads to the metallic region in the electronic device through the second portion of the first dielectric sheet.

8. The electronic device of claim 1, further comprising a graphite sheet disposed between the metal frame structure and the rear plate.

9. The electronic device of claim 8, wherein the first dielectric sheet further comprises a first portion attached to the at least one partial region of the radiation surface of the antenna module and a second portion substantially perpendicular to the first portion and being in contact with a partial region of the graphite sheet.

10. The electronic device of claim 9, wherein heat that is generated by the at least one antenna module spreads to the graphite sheet through the second portion of the first dielectric sheet.

11. The electronic device of claim 1, wherein the first dielectric sheet has a first region attached to the radiation surface of the at least one antenna module and a second region protruding from the first region in the first direction or the third direction, and wherein the second region operates as a heat spreader configured to dissipate heat that is generated by the at least one antenna module to a surrounding of the second region.

12. The electronic device of claim 1, wherein the at least one antenna module comprises:

a printed circuit board; and the antenna array being disposed on the printed circuit board and comprising a plurality of antenna elements configured to transmit or receive an RF signal in the predetermined frequency band.

13. The electronic device of claim 12, wherein the second dielectric sheet comprises at least one first opening formed at a position corresponding to at least a partial region of the plurality of antenna elements.

14. The electronic device of claim 13, further comprising:

a third dielectric sheet disposed between the first dielectric sheet and the second dielectric sheet and having a third permittivity, wherein the third dielectric sheet has at least one second opening formed at a position corresponding to at least a partial region of the plurality of antenna elements.

15. The electronic device of claim 13, wherein an outer surface of the at least one first opening is formed in a shape including an outer surface of the plurality of antenna elements.

16. The electronic device of claim 14, wherein an outer surface of the at least one second opening is formed in a shape including an outer surface of the at least one first opening.

17. An electronic device comprising:

a display having a first surface facing a first direction;

a metal frame structure configured to form a side surface of the electronic device, the metal frame structure facing a second direction perpendicular to the first direction;

a rear plate having a second surface facing a third direction opposite to the first direction;

at least one antenna module disposed inside the side surface and having a radiation surface facing the second direction;

at least one dielectric layer having at least a partial region attached to an inner side of the side surface, and disposed between the at least one antenna module and the side surface; and a wireless communication circuit configured to transmit or receive an RF signal in a predetermined frequency band to or from the at least one antenna module, wherein the at least one dielectric layer comprises a first dielectric sheet disposed on the radiation surface of the at least one antenna module in the second direction and a second dielectric sheet disposed between the first dielectric sheet and the side surface and having a surface attached to the inner side of the side surface, and wherein the first dielectric sheet comprises a thermal conductive material having a first permittivity and the second dielectric sheet comprises a material having a second permittivity larger than the first permittivity.

18. The electronic device of claim 17, further comprising a third dielectric sheet disposed between the first dielectric sheet and the second dielectric sheet and having a third permittivity.

19. The electronic device of claim 18, wherein the third permittivity is larger than the first permittivity and smaller than the second permittivity.

20. An electronic device comprising:

a display having a first surface facing a first direction;

a metal frame structure configured to form a side surface of the electronic device, the side surface facing a second direction perpendicular to the first direction;

a rear plate having a second surface facing a third direction opposite to the first direction;

at least one antenna module disposed inside the side surface;

at least one dielectric layer disposed between the at least one antenna module and the side surface; and a wireless communication circuit configured to transmit or receive a radio frequency (RF) signal in a predetermined frequency band to or from the at least one antenna module, wherein the at least one antenna module comprises a printed circuit board having a third surface facing the second direction and a fourth surface facing an opposite direction to the second direction, and a plurality of antenna elements disposed on the third surface of the printed circuit board, wherein the at least one dielectric layer comprises a first dielectric sheet attached to at least a partial region of the third surface of the printed circuit board and made of a thermal conductive material having a first permittivity and a second dielectric sheet disposed on the first dielectric sheet in the second direction and made of a material having a second permittivity larger than the first permittivity, and wherein the second dielectric sheet comprises at least one first opening formed at a position corresponding to at least a partial region of the plurality of antenna elements.

* * * * *